US010383489B2

(12) United States Patent
Case et al.

(10) Patent No.: US 10,383,489 B2
(45) Date of Patent: Aug. 20, 2019

(54) AUTOMATIC NAPKIN DISPENSER

(71) Applicant: GPCP IP Holdings LLC, Atlanta, GA (US)

(72) Inventors: Abby C. Case, Green Bay, WI (US); David James Gennrich, Fitchburg, WI (US); Stephen Andrew Latham, Sun Prairie, WI (US); Christopher Timothy Strahm, Deforest, WI (US); Kent J. Kallsen, Jefferson, WI (US); Ted Allen Casper, Neenah, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 14/576,534

(22) Filed: Dec. 19, 2014

(65) Prior Publication Data

US 2015/0102048 A1 Apr. 16, 2015

Related U.S. Application Data

(63) Continuation-in-part of application No. 13/370,511, filed on Feb. 10, 2012.

(51) Int. Cl.

| | |
|---|---|
| ***A47K 10/42*** | (2006.01) |
| ***B65H 45/14*** | (2006.01) |
| ***B65H 45/18*** | (2006.01) |
| ***B65H 35/10*** | (2006.01) |

(52) U.S. Cl.

CPC ..... *A47K 10/42* (2013.01); *B65H 35/10* (2013.01); *B65H 45/142* (2013.01); *B65H 45/18* (2013.01); *B65H 2701/1924* (2013.01)

(58) Field of Classification Search

CPC ..... A47K 10/42; B65H 45/18; B65H 45/182; B65H 35/10; B65H 2701/1924

USPC ..... 221/33–63; 700/231–244

See application file for complete search history.

(56) References Cited

U.S. PATENT DOCUMENTS

| | | | |
|---|---|---|---|
| 390,328 | A | 10/1888 | Wheeler |
| 400,913 | A | 4/1889 | Hicks |
| 453,003 | A | 5/1891 | Hicks |
| 459,516 | A | 9/1891 | Wheeler |
| 511,983 | A | 1/1894 | Wheeler |
| 607,498 | A | 7/1898 | Wheeler |
| 2,007,544 | A | 7/1935 | Meisel |

(Continued)

FOREIGN PATENT DOCUMENTS

| | | |
|---|---|---|
| AU | 654722 | 11/1994 |
| CA | 2633158 A1 | 12/2009 |

(Continued)

OTHER PUBLICATIONS

Georgia-Pacific LLC, "Relevant Information Regarding Other Georgia Pacific Towel & Tissue Dispensers," Mar. 2013, 1 page.

(Continued)

*Primary Examiner* — Michael Collins

(57) ABSTRACT

The present application provides a tucker fold dispenser for folding and dispensing a sheet of material. The tucker fold dispenser may include an outer shell, a removable roller cassette positioned within the outer shell, a paper path therethrough, a number of loading rollers positioned about the paper path, a number of folding rollers positioned about the paper path, and a tucker bar mechanism positioned about the folding rollers.

24 Claims, 19 Drawing Sheets

(56) References Cited

U.S. PATENT DOCUMENTS 2,053,786 A 9/1936 Straubel
2,105,707 A 1/1938 Stancliff
2,328,109 A 8/1943 Thompson
2,637,503 A 5/1953 Birr
2,693,321 A 11/1954 Birr
2,751,222 A 6/1956 Dexter
2,993,658 A 7/1961 Sweeney
3,040,943 A 6/1962 Bump
3,276,706 A 10/1966 House
3,326,365 A 6/1967 Neureither et al.
3,570,335 A 3/1971 Mahn
3,784,188 A 1/1974 DeLigt
3,845,289 A 10/1974 French
3,858,476 A 1/1975 Deligt
3,861,985 A 1/1975 Parlagreco
3,877,576 A 4/1975 Kishi
3,935,802 A 2/1976 Perrin et al.
4,134,521 A 1/1979 Pecht
4,236,679 A 12/1980 Jespersen
4,317,547 A 3/1982 Graham, Jr. et al.
4,378,912 A 4/1983 Perrin et al.
4,403,748 A 9/1983 Cornell
4,457,964 A 7/1984 Kaminstein
4,467,974 A 8/1984 Crim
4,521,209 A 6/1985 DeFresne
4,552,315 A 11/1985 Granger
4,566,608 A 1/1986 Draper et al.
4,621,755 A 11/1986 Granger
4,627,117 A 12/1986 Morishita
4,643,705 A 2/1987 Bober et al.
4,648,530 A 2/1987 Granger
4,651,895 A 3/1987 Niske et al.
4,691,503 A 9/1987 French
4,753,369 A 6/1988 Morrison
4,756,485 A 7/1988 Bastian et al.
4,802,412 A * 2/1989 Edwards ..... B41L 19/00 101/269
4,807,824 A 2/1989 Gains et al.
4,846,412 A 7/1989 Morand
4,856,724 A 8/1989 Jespersen
4,905,868 A 3/1990 Beane et al.
4,928,432 A * 5/1990 Yang ..... B24B 7/16 451/212
4,944,466 A 7/1990 Jespersen
5,044,873 A 9/1991 Vijuk
5,048,809 A 9/1991 Tebbe et al.
5,054,676 A 10/1991 Ban
5,064,179 A 11/1991 Martin
5,131,302 A * 7/1992 Watanabe ..... A47K 10/3656 83/167
5,135,147 A 8/1992 Granger
5,205,454 A 4/1993 Schutz et al.
RE34,288 E 6/1993 Beck et al.
5,244,161 A 9/1993 Wirtz-Odentahl
5,246,137 A 9/1993 Schutz et al.
5,310,398 A 5/1994 Yoneyama
5,364,332 A 11/1994 Gray
5,370,267 A 12/1994 Schroeder
5,371,267 A 12/1994 Seitz et al.
5,386,950 A * 2/1995 Abt ..... B65H 18/20 242/532
5,405,127 A * 4/1995 Welborn ..... B41F 13/56 270/21.1
2,726,823 A 12/1995 Jespersen
5,496,605 A 3/1996 Augst et al.
5,526,973 A 6/1996 Boone et al.
5,582,362 A 12/1996 Johnson et al.
5,625,659 A 4/1997 Sears
5,630,526 A 5/1997 Moody
5,704,566 A 1/1998 Schutz et al.
5,715,971 A 2/1998 Morand
5,757,664 A 5/1998 Rogers et al.
5,765,718 A 6/1998 Grasso et al.
5,785,274 A 7/1998 Johnson
5,836,862 A 11/1998 Granger
5,846,412 A 12/1998 Tharp
5,868,275 A 2/1999 Moody
5,878,381 A 3/1999 Gemmell et al.
5,918,197 A 6/1999 Toussant et al.
5,979,822 A 11/1999 Morand et al.
6,000,429 A 12/1999 Van Marcke
6,010,090 A 1/2000 Bushmaker
6,029,921 A 2/2000 Johnson et al.
6,059,711 A 5/2000 Wang
6,065,639 A 5/2000 Maddox et al.
6,090,467 A 7/2000 Yip
6,092,726 A 7/2000 Toussant et al.
6,109,473 A 8/2000 Neveu et al.
6,129,240 A 10/2000 Morand
6,145,779 A 11/2000 Johnson et al.
6,145,782 A 11/2000 King et al.
6,152,397 A 11/2000 Purcell
6,189,163 B1 2/2001 Van Marcke
6,228,454 B1 5/2001 Johnson et al.
6,237,871 B1 5/2001 Morand et al.
6,352,172 B1 3/2002 Chan et al.
6,360,181 B1 3/2002 Gemmell et al.
6,375,038 B1 4/2002 Daansen et al.
6,401,045 B1 6/2002 Rogers et al.
6,404,837 B1 6/2002 Thompson et al.
6,411,920 B1 6/2002 McConnell et al.
6,440,052 B1 8/2002 Reider et al.
6,447,864 B2 9/2002 Johnson et al.
6,460,727 B1 10/2002 Irwin
6,464,120 B1 10/2002 Johnson et al.
6,519,505 B2 2/2003 Formon
6,536,624 B2 3/2003 Johnson et al.
6,554,158 B2 * 4/2003 Kapiloff ..... G07F 11/68 221/277
6,561,598 B2 5/2003 Granger
6,581,500 B1 6/2003 Kietaibl
6,592,013 B1 7/2003 Fujiwara
6,592,067 B2 7/2003 Denen et al.
6,622,888 B2 9/2003 Boone et al.
6,644,503 B2 11/2003 Peterson et al.
6,651,922 B1 11/2003 Quimpo
6,684,751 B2 2/2004 Kapiloff et al.
6,685,074 B2 2/2004 Vish et al.
6,691,061 B1 2/2004 Rogers et al.
6,704,616 B2 3/2004 Formon et al.
6,704,617 B2 3/2004 Cherfane et al.
6,707,873 B2 3/2004 Thompson et al.
6,736,348 B1 5/2004 Formon et al.
6,826,991 B1 12/2004 Rasmussen
6,838,887 B2 1/2005 Denen et al.
6,851,500 B2 2/2005 Horii et al.
6,860,447 B2 3/2005 Boone et al.
6,871,815 B2 3/2005 Moody et al.
6,874,653 B2 4/2005 Boone et al.
6,883,563 B2 4/2005 Smith
6,884,209 B2 4/2005 Roozrokh
6,889,970 B2 5/2005 Takahashi et al.
6,892,898 B1 5/2005 Boone et al.
6,895,296 B2 5/2005 Holt et al.
6,909,986 B2 6/2005 Rogers et al.
6,915,980 B2 * 7/2005 Tsuruga ..... B65H 29/008 108/108
6,925,397 B2 8/2005 Rogers et al.
6,934,644 B2 8/2005 Rogers et al.
6,964,395 B1 11/2005 Lewis et al.
6,969,885 B2 11/2005 King
6,997,094 B2 2/2006 Granger
7,063,656 B1 6/2006 Lindsay
7,066,070 B2 6/2006 Granger et al.
7,072,738 B2 7/2006 Bonney et al.
7,085,618 B2 8/2006 Holt et al.
7,122,005 B2 10/2006 Shusterman
7,131,609 B1 11/2006 Lewis et al.
7,137,539 B2 11/2006 Jackson
7,168,602 B2 1/2007 Broehi
7,177,725 B2 2/2007 Nortier et al.
7,177,780 B2 2/2007 Hillam et al.
7,178,561 B2 2/2007 Memmott et al.

(56) References Cited

U.S. PATENT DOCUMENTS 7,181,361 B2 2/2007 Memmott et al.
7,185,683 B2 3/2007 Hillam et al.
7,197,409 B2 3/2007 Hillam et al.
7,213,782 B2 5/2007 Osborne et al.
7,234,610 B2 6/2007 Skarda et al.
7,242,307 B1 7/2007 LeBlond et al.
7,275,655 B2 10/2007 Duff et al.
7,275,672 B2 10/2007 Pierquet et al.
7,346,427 B2 3/2008 Hillam et al.
7,370,824 B1 5/2008 Osborne
7,370,826 B2 5/2008 Neveu
7,411,511 B2 8/2008 Kennish et al.
7,416,162 B2 8/2008 Wieser et al.
7,423,533 B1 9/2008 LeBlond et al.
7,454,267 B2 11/2008 Bonney et al.
7,536,264 B2 5/2009 Hillam et al.
7,546,256 B2 6/2009 Hillam et al.
7,574,385 B2 8/2009 Hillam et al.
7,590,467 B2 9/2009 Holt et al.
7,606,632 B2 10/2009 Roberts
7,689,371 B2 3/2010 Memmott et al.
7,726,599 B2 6/2010 Lewis et al.
7,774,096 B2 8/2010 Goerg et al.
7,783,380 B2 8/2010 York et al.
7,783,435 B2 8/2010 Hillam et al.
7,791,490 B2 9/2010 Kennish et al.
7,805,340 B2 9/2010 Blakeslee et al.
7,806,291 B2 10/2010 Anderson
7,814,582 B2 10/2010 Reddy et al.
7,832,678 B2 11/2010 Hjort et al.
7,837,077 B2 11/2010 Formon et al.
7,855,651 B2 12/2010 LeBlond et al.
7,954,405 B2 6/2011 King
7,955,797 B2 6/2011 McManus et al.
7,966,879 B2 6/2011 Dietz et al.
7,967,235 B2 6/2011 Forman et al.
7,971,514 B2 7/2011 Alalu
7,975,955 B2 7/2011 Takeuchi
7,996,108 B2 8/2011 Yardley
8,066,217 B2 11/2011 Cittadino et al.
8,094,029 B2 1/2012 Ortiz et al.
8,160,742 B2 4/2012 Goerg et al.
8,181,899 B2 5/2012 Marietta-Tondin et al.
8,245,879 B2 8/2012 Wegelin
8,298,640 B2 10/2012 Cattacin et al.
8,342,360 B2 1/2013 Long
8,350,706 B2 1/2013 Wegelin et al.
8,364,546 B2 1/2013 Yenni et al.
8,366,035 B2 2/2013 Kling et al.
8,517,618 B2 8/2013 Cartwright et al.
8,590,738 B2 11/2013 Formon et al.
8,616,486 B2 12/2013 Billman et al.
8,899,508 B2 12/2014 Kullman et al.
8,899,509 B2 12/2014 Hjort et al.
8,939,392 B2 1/2015 Granger
9,604,811 B2 3/2017 Case et al.
9,701,508 B2 7/2017 Diamond
9,770,143 B2 9/2017 Corley et al.
10,117,549 B2 11/2018 Atalla
2002/0033405 A1 3/2002 Gergek
2002/0139488 A1 10/2002 Parker
2003/0109368 A1 6/2003 Kitai et al.
2003/0169046 A1 9/2003 Morris
2003/0183717 A1 10/2003 Chen et al.
2004/0254054 A1* 12/2004 Suzuki ..... B65H 29/52 493/405
2005/0067519 A1 3/2005 King et al.
2005/0156081 A1 7/2005 Schaeffer
2006/0157148 A1 7/2006 Hillam et al.
2006/0167967 A1 7/2006 Defosse
2006/0175344 A1 8/2006 Skarda et al.
2006/0273100 A1* 12/2006 Cittadino ..... A47K 10/426 221/33
2007/0090132 A1 4/2007 Williams et al.
2007/0098944 A1 5/2007 Mitchell
2008/0004507 A1 1/2008 Williams, Jr. et al.
2008/0073371 A1 3/2008 Neiberger et al.
2008/0173661 A1 7/2008 Neveu
2008/0185395 A1 8/2008 Sahud
2008/0197142 A1 8/2008 Langen et al.
2008/0280088 A1 11/2008 Baum
2009/0120951 A1 5/2009 Titas et al.
2009/0125424 A1 5/2009 Wegelin
2009/0155512 A1 6/2009 Neto et al.
2009/0204256 A1 8/2009 Wegelin
2009/0212153 A1 8/2009 Alalu
2009/0319072 A1 12/2009 Fukui et al.
2010/0075094 A1 3/2010 Cattacin et al.
2010/0094581 A1 4/2010 Cagle
2010/0114366 A1 5/2010 Case et al.
2010/0170979 A1 7/2010 Lewis et al.
2010/0224647 A1 9/2010 Formon et al.
2010/0304945 A1 12/2010 Ang
2011/0011886 A1 1/2011 Zaima et al.
2011/0132920 A1 6/2011 Petocchi et al.
2011/0139920 A1 6/2011 Formon et al.
2011/0163870 A1 7/2011 Snodgrass
2011/0168831 A1 7/2011 Mok et al.
2011/0169643 A1 7/2011 Cartner
2011/0169645 A1 7/2011 Cartner et al.
2011/0169646 A1 7/2011 Raichman
2011/0177278 A1 7/2011 Neto et al.
2011/0184864 A1 7/2011 Mon et al.
2011/0210137 A1 9/2011 Kling
2011/0226883 A1 9/2011 Forman et al.
2011/0232367 A1 9/2011 McManus et al.
2011/0233254 A1 9/2011 Lundqvist et al.
2011/0252883 A1 10/2011 Dietz et al.
2011/0254214 A1* 10/2011 Walsh ..... B65H 31/3045 270/45
2011/0316701 A1 12/2011 Alper et al.
2011/0319244 A1 12/2011 Toyoizumi et al.
2012/0037746 A1 2/2012 Cittadino et al.
2012/0138625 A1* 6/2012 Case ..... A47K 10/42 221/30
2012/0218106 A1 8/2012 Zaima et al.
2012/0235313 A1 9/2012 Yan et al.
2012/0237711 A1 9/2012 Cattacin et al.
2012/0245729 A1 9/2012 Wegelin et al.
2012/0249331 A1 10/2012 Wegelin et al.
2012/0256037 A1 10/2012 Nordlund
2013/0040089 A1 2/2013 Cattacin et al.
2013/0052408 A1 2/2013 Carlson
2013/0161346 A1 6/2013 Wolme et al.
2014/0263387 A1 9/2014 Muehl et al.
2015/0102048 A1* 4/2015 Case ..... B65H 45/142 221/1
2015/0282678 A1 10/2015 Larsson et al.
2015/0336765 A1 11/2015 Sawada et al.
2016/0088982 A1* 3/2016 Larsson ..... A47K 10/422 221/2
2017/0188759 A1 7/2017 Borke
2017/0190535 A1 7/2017 Case et al.
2017/0258278 A1 9/2017 Moody et al.
2017/0290473 A1 10/2017 Borke et al.
2017/0296004 A1 10/2017 Borke
2018/0208424 A1 7/2018 Case et al.

FOREIGN PATENT DOCUMENTS

CN 101068494 A 11/2007
DE 20107189 U1 8/2001
DE 10256295 A1 7/2003
DE 20314147 U1 1/2004
EP 865247 B1 3/2002
EP 930039 B1 11/2002
GB 1308905 A 3/1973
GB 2377204 A 1/2003
GB 2489965 A 10/2012
JP 63051254 3/1988
JP H11-178741 A 7/1999
JP 11244184 A 3/2000
JP 2002-17601 A 1/2002

(56) References Cited

FOREIGN PATENT DOCUMENTS

| | | | |
|---|---|---|---|
| JP | 2003-144344 | A | 5/2003 |
| JP | 2004-129863 | A | 4/2004 |
| JP | 2005-065730 | A | 3/2005 |
| JP | 2009-039226 | A | 2/2009 |
| NL | 1036213 | A1 | 1/2009 |
| WO | 9721377 | A1 | 6/1997 |
| WO | 98/37794 | A1 | 9/1998 |
| WO | 2010/141689 | A2 | 12/2010 |
| WO | 2011/074946 | A1 | 6/2011 |
| WO | 2012/034590 | A1 | 3/2012 |
| WO | 2012/102608 | A1 | 8/2012 |
| WO | 2013119940 | A1 | 8/2013 |
| WO | 2014118483 | A1 | 8/2014 |

OTHER PUBLICATIONS

International Search Report and Written Opinion of the International Searching Authority for PCT/US2013/025334 dated May 15, 2013, 11 pages.

"International Search Report and Written Opinion for PCT/US2014/015524; dated May 9, 2014".

"International Search Report and Written Opinion of the International Search Authority for PCT/FR2007/001737; dated Oct. 31, 2008".

Nilsson, et al., Nilsson, Ulrika and Volme, Lisa; ReDesign of RollNap, a Technical and Aesthetical Development of a Napkin Dispenser; University Essay from Lunds Universitet/Maskinkonstruktion; LTH; 2010, 121 pages; http://www.essays.se/essay/1629aeca878/.

Supplementary European Search Report of EP 13 74 6627, mailed by the European Patent Office dated Mar. 16, 2016.

International Search Report of International Application No. PCT/US2015/066015, mailed by the International Searching Authority dated Apr. 8, 2016.

Written Opinion of International Application No. PCT/US2015/066015, mailed by the International Searching Authority dated Apr. 8, 2016.

Office Action (Notice of Grounds for Rejection) of JP Application No. 2014-556723, mailed by the Japanese Patent Office dated Nov. 1, 2016.

English translation of JP Application No. 2003-144344, cited in the Information Disclosure Statement submitted on Oct. 31, 2013.

English translation of JP Application No. 2009-039226, cited in the Information Disclosure Statement submitted on Oct. 31, 2013.

International Search Report and Written Opinion of International Application No. PCT/US2014/058283, dated Jan. 15, 2015, 11 pages.

International Search Report and Written Opinion for PCT/US2018/032099; dated Sep. 11, 2018.

* cited by examiner

Fig. 3
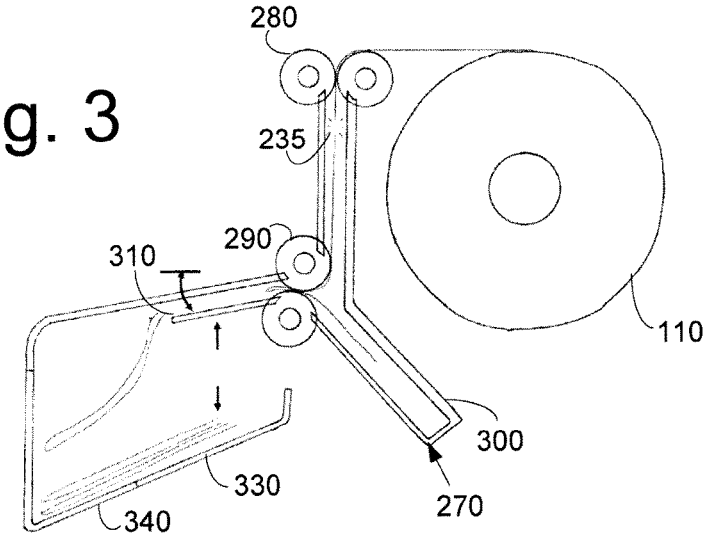
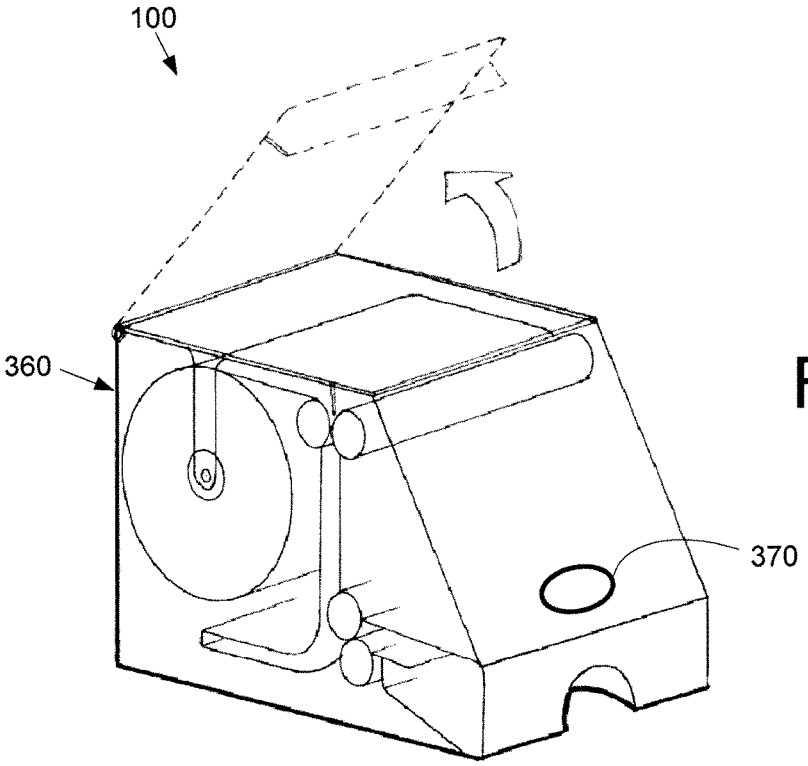
Fig. 4

AUTOMATIC NAPKIN DISPENSER

RELATED APPLICATIONS

The present application is a continuation-in-part of U.S. patent application Ser. No. 13/370,511, filed on Feb. 10, 2012, entitled "Automated Napkin Dispenser," now pending, incorporated by reference herein in full.

TECHNICAL FIELD

The present application and the resultant patent relate generally to a napkin dispenser and more particularly relate to an automatic napkin dispenser that folds and dispenses one or more napkins or groups of napkins in a controlled and efficient fashion from a continuous roll of sheet material.

BACKGROUND OF THE INVENTION

Dispensers, such as napkin dispensers, generally are configured to enable the end user to retrieve products such as napkins and the like for personal use. Although conventional dispensers adequately dispense the products therein, such dispensers also enable end users to obtain any number of napkins with no control mechanisms. Moreover, such conventional dispensers tend to allow napkins to be soiled due to contact with the surrounding environment during storage and/or dispensing. As such, excessive distribution of napkins, prematurely soiled napkins, and other types of waste thus may lead to unnecessary operating expenses.

Known dispensers generally provide a stack of folded napkins therein. Establishments, such as quick service restaurants and the like, must maintain a ready supply of such napkins and also must continuously refill the dispensers to ensure customer satisfaction. Such pre-folded napkins, however, generally may be more expensive than, for example, a continuous roll of napkin material or other types of sheet material. Moreover, any type of napkin also requires the time and expense to refill continuously the dispensers.

There is thus a desire for improved napkin dispensers and methods of dispensing napkins and the like. Such improved dispensers and methods may provide for controlled, automatic dispensing of napkins and similar types of paper products in an economical, efficient, and sanitary fashion so as to limit or eliminate unnecessary waste and expense.

SUMMARY OF THE INVENTION

The present application and the resultant patent thus provide a tucker fold dispenser for folding and dispensing a sheet of material. The tucker fold dispenser may include an outer shell, a removable roller cassette positioned within the outer shell, a paper path therethrough, a number of loading rollers positioned about the paper path, a number of folding rollers positioned about the paper path, and a tucker bar mechanism positioned about the folding rollers.

The present application and the resultant patent further provide a method of dispensing a napkin from a roll of sheet material. The method may include the steps of pulling a tail of the sheet material through a number of feed rollers, driving the sheet material along a paper path, activating a tucker bar mechanism, creating a fold in the sheet material by a number of folding rollers, and lofting the napkin into a presentation tray by the plurality of folding rollers.

The present application and the resultant patent further provide a dispenser for folding and dispensing a number of napkins. The dispenser may include a paper path therethrough, a number of folding rollers positioned about the paper path, and a presentation tray positioned about the folding rollers. The presentation tray may include a downwardly angled orientation and a front facing opening such that the folding rollers fold each napkin and project each napkin towards the presentation tray where the napkins form a stack therein.

These and other features and improvements of the present application and the resultant patent will become apparent to one of ordinary skill in the art upon review of the following detailed description when taken in conjunction with the several drawings and the appended claims.

BRIEF DESCRIPTION OF THE DRAWINGS

FIG. 3 is a partial side plan view of the napkin dispenser of FIG. 2.

FIG. 4 is a perspective view of a second alternative embodiment of a napkin dispenser as may be described herein with a partially transparent outer shell.

DETAILED DESCRIPTION

Figure 1:
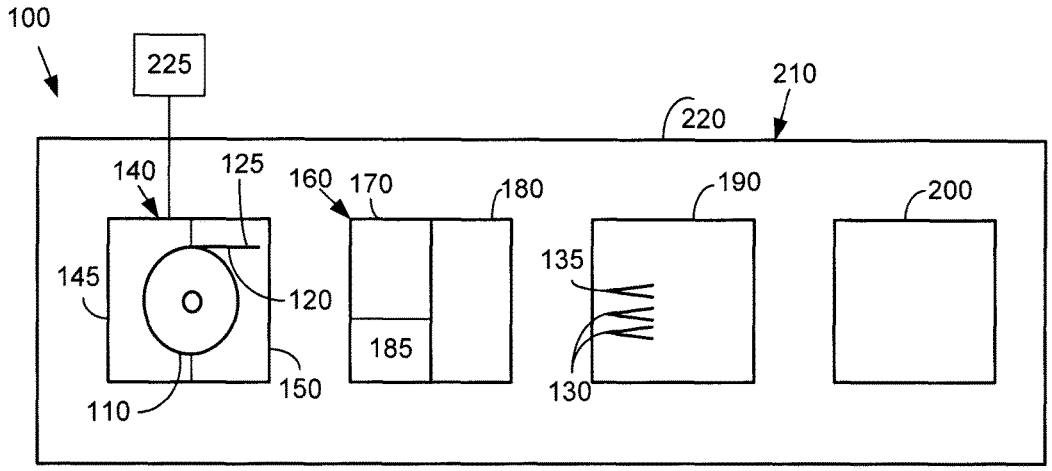
FIG. 1 is a schematic view of a napkin dispenser as may be described herein.

Referring now to the drawings, in which like numerals refer to like elements throughout the several views, FIG. 1 shows a schematic diagram of an example of a napkin dispenser 100 as may be described herein. As will be described in more detail below, the napkin dispenser 100 may take many different sizes, shapes, and configurations and may use many different types of components. Moreover, the components described in the examples below may be interchangeable such that the napkin dispenser 100 is not limited to the given components or configurations of any one example. Rather, any of the components described herein and the like may be used together in any combination or orientation.

Generally described, the napkin dispenser 100 may use one or more continuous rolls 110 of a sheet material 120. Any suitable number of the rolls 110 may be used in the napkin dispenser 100. The sheet material 120 may include any type of natural and/or synthetic cloth or paper sheets including woven and non-woven articles. The sheet material 120 may or may not include perforations at given intervals. The leading end of the sheet material 120 on each roll 110 may be considered a tail 125. The napkin dispenser 100 separates and folds the sheet material 120 to produce a number of napkins 130 with a fold 135 therein. The fold 135 may be a hard fold with a crease therein or more of a "U" or a "C"-shaped configuration. Moreover, multiple folds 135 also may be created, i.e., a "Z"-shaped fold or a dinner napkin fold also may be created herein.

The napkin dispenser 100 thus includes a number of stations so as to produce the napkins 130 from the sheet material 120 on the roll 110. These stations may include a loading station 140. The loading station 140 accepts the roll 110 of the sheet material 120 therein. The loading station 140 may include a loading mechanism 145 and a transfer mechanism 150. The napkin dispenser 100 also may include a folding station 160. The folding station 160 may perform a number of functions. The folding station 160 thus may include a folding mechanism 170 and a cutting mechanism 180. The folding mechanism 170 also may provide napkin separation as will be described in more detail below, either with or without the cutting mechanism 180, as a speed mechanism 185.

The napkin dispenser 100 also may include a presentation station 190. The presentation station 190 provides the napkins 130 to an end user. The napkin dispenser 100 also may include a user interface 200. The user interface 200 may allow the end user to select the number of napkins 130 and the like as well as allowing the end user to initiate a dispense. These stations and the other components of the napkin dispenser 100 may be enclosed in whole or in part in an outer shell 210. The outer shell 210 may be made out of any type of substantially rigid material. The outer shell 210 may have one or more loading doors 220 thereon. The napkin dispenser 100 also may be in communication with a cash register 225 or other type of ordering or input device. Other components and other mechanisms also may be used herein in many different configurations.

Figure 2:
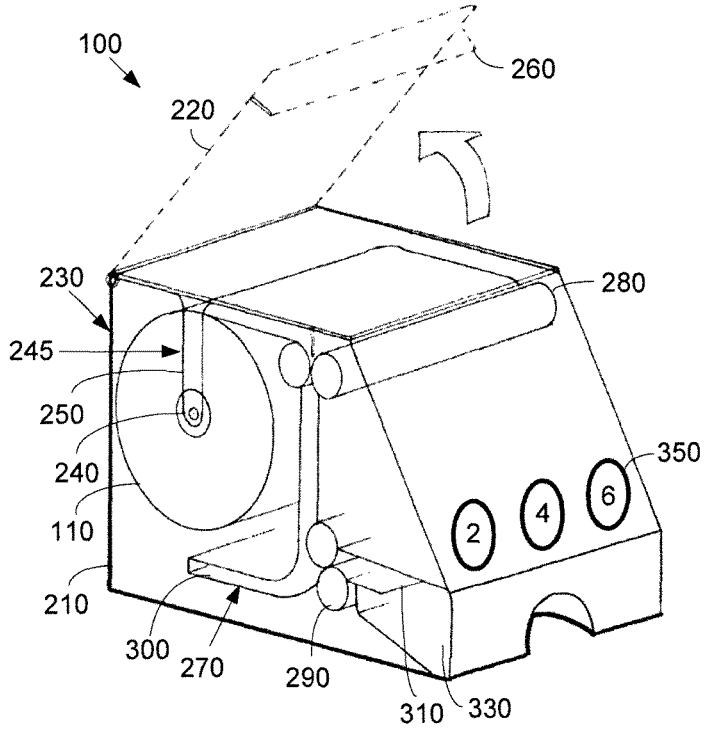
FIG. 2 is a perspective view of an example of a napkin dispenser as may be described herein with a partially transparent outer shell.

FIGS. 2 and 3 show a first example of the napkin dispenser 100 as may be described herein as a single roll, buckle fold, horizontal dispenser 230. The dispenser 230 may include a single roll 110. The single roll 110 may have a number of perforations 235 at substantially uniform intervals. The loading mechanism 145 of the loading station 140 may include a slot mechanism 245 having a pair of spindle plugs 240 in the roll 110 and a pair of slots 250 formed in the outer shell 210. The slots 250 are configured to accommodate the spindle plugs 240 therein. The loading door 220 also may have a tucker finger 260 sized to accommodate the sheet material 120 as will be described below.

The folding station 160 may include the folding mechanism 170 in the form of a buckle fold mechanism 270. The buckle fold mechanism 270 may include a first pair of pinch rollers 280 and a second pair of pinch rollers 290. The buckle fold mechanism 270 also may include a buckle tray 300 and a dispense shelf 310. The first pair of pinch rollers 280 may be positioned about the roll 110 and the loading door 220. The second pair of pinch rollers 290 may be positioned operationally downstream about the buckle tray 300 and the dispense shelf 310. The second pair of pinch rollers 290 may be aligned with the first pair of pinch rollers 280 as the tail 125 descends. The buckle tray 300 may be sized to accommodate the desired length of the napkin 130. The pinch rollers 280, 290 may be spring loaded and may be motor driven. Each pair of pinch rollers 280, 290 may be driven at different speeds. Stripper fingers between the pinch rollers also may be used herein.

The presentation station 190 may include a presentation tray 330. The presentation tray 330 may be semi-covered. The presentation tray 330 may include an offset angle 340 so as to stack the napkins 130 therein. The angle of the buckle tray 340 may be about 140 degrees or so. Other angles may be used herein. The presentation tray 330 also may have multiple retracting shelves therein as will be described in more detail below. The user interface 220 may include a number of push buttons 350. The push buttons 350 may be any type of mechanical or electrical selector and the like. The push buttons 350 may indicate the number of napkins 130 to be dispensed therefrom. Although push buttons 350 for two, four, and six napkins 130 are shown, any suitable number of the napkins 130 may be used herein with any number or orientation of the push buttons 350. A single napkin hang mode also may be used.

In use, the roll 110 may be dropped into the outer shell 210 via the loading door 220 along the slots 250 of the slot mechanism 245. The tail 125 of the roll 110 may be placed over the first pair of pinch rollers 280. The tucker finger 260 on the loading door 220 may push the tail 125 between the first pair of pinch rollers 280 to load the tail 125 therein when the loading door 220 is shut. The buckle fold mechanism 270 creates the fold 135 by driving the tail 125 into the buckle tray 300. Once the tail 125 hits the buckle tray 300, the sheet material 120 begins to buckle and the second pair of pinch rollers 290 drives the fold 135 therethrough. The perforation 235 may be separated based upon a speed differential between the first and the second pair of the pinch rollers 280, 290 acting as the speed mechanism 185. The speed differential may be about two to one or so as to separate the perforation 235 between the pinch rollers 280, 290. Once the perforation 235 is separated, the napkin 130 may drop along the dispense shelf 310 into the presentation tray 330. Specifically, the number of napkins 130 as indicated by the push buttons 350 may drop into the presentation tray 330. The napkins 130 may be removed as a group by the end user. The presentation tray 330 then may be reloaded as above. Other components and other configurations may be used herein.

FIG. 4 shows a further example of a single roll, buckle fold, vertical dispenser 360. The dispenser 360 may be largely similar to the dispenser 230 described above except for the user interface 200. Instead of the push buttons 350, the user interface 200 may include one or more sensors 370. Each sensor 370 may be any type of motion sensor such as photoelectric, infrared, and the like that does not require physical contact. The sensor 370 may be suitably positioned anywhere on the outer shell 210. The dispenser 360 thus may be activated by the end user waving his or her hand thereabout. The dispenser 360 may be set to dispense a predetermined number of napkins 130 or a single napkin 130 may be dispensed for each wave of the end user's hand about the sensor 370. The dispenser 360 may dispense the napkins 130 into the presentation tray 330 or directly into the end user's hand. The presentation tray 330 then may be reloaded as above. Other components and other configurations may be used herein.

Figure 5:
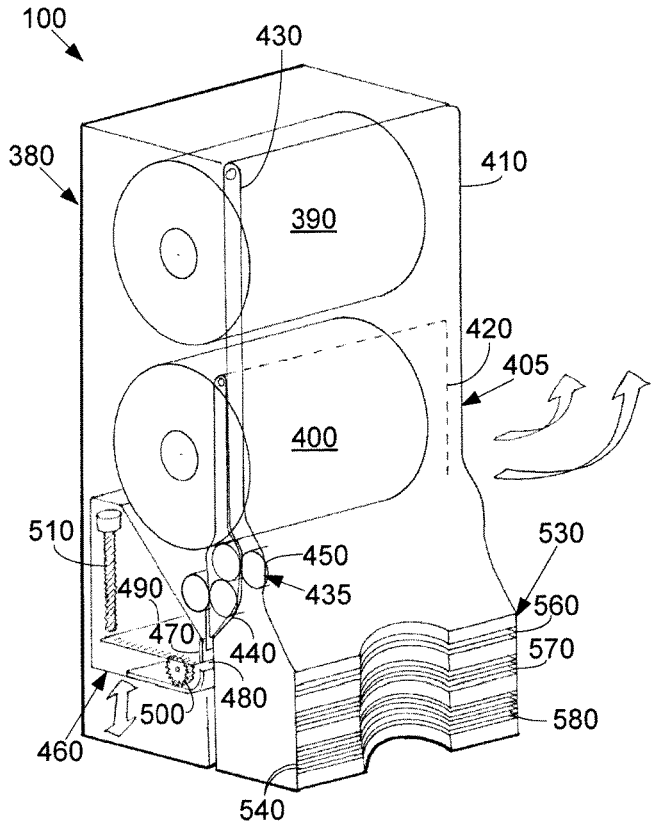
FIG. 5 is a perspective view of a third alternative embodiment of a napkin dispenser as may be described herein with a partially transparent outer shell.
Figure 6:
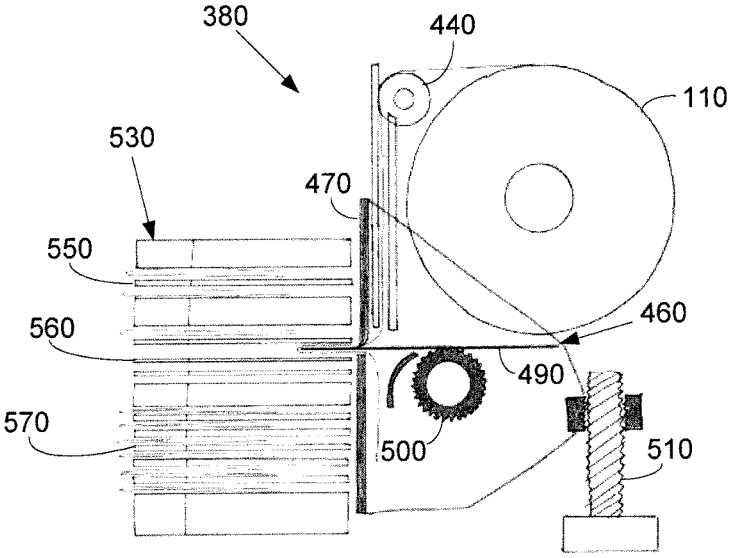
FIG. 6 is a partial side plan view of the napkin dispenser of FIG. 5.

FIGS. 5 and 6 show a third example of the napkin dispenser 100 as may be described herein as a multiple roll, slot fold, vertical dispenser 380. The dispenser 380 may include two or more of the rolls 110. In this case, a first roll 390 and a second roll 400 may be used although any suitable number may be used herein. The loading mechanism 145 of the loading station 140 may include a door loading mechanism 405 with a number of the loading doors 220. Each roll 390, 400 may have its own loading door 220 with the first roll 390 having a first loading door 410 and the second roll 400 having a second loading door 420. Each door 410, 420 may be held open via a door prop 430. The door prop 430 may include a prop rod operating in a pen click like mechanism and the like. The loading doors 410, 420 may be held closed via magnets and the like. The transfer mechanism 150 may include a roller mechanism 435 with each door 410, 420 having a pair of spring loaded pinch rollers positioned thereabout. Specifically, a first pair of pinch rollers 440 may be positioned about the first door 410 and a second pair of pinch rollers 450 may be positioned about the second door 420. One of the rollers 440, 450 may be positioned on each of the doors 410, 420 with one positioned internally. Other positions may be used herein. The pinch rollers 440, 450 may be motor driven, i.e., drive rollers. A sensor may be used to determine when one of the rolls 390, 400 is depleted so as to start the pair of pinch rollers 440, 450 of the other roll.

The folding station 160 of the dispenser 380 may include the folding mechanism 170 as a slot fold mechanism 460. The slot fold mechanism 460 may include a vertical plate 470 with a thin slot 480 therein. A horizontal pusher plate 490 may be positioned opposed the slot 480 and may include a plate drive motor 500 for largely horizontal motion. The upper edge of the slot 480 may create as little friction as possible while the lower edge may create a friction force thereabout. As such, a sharp, slightly offset corner may be used. The leading edge of the pusher plate 490 also may have sharp corners to create a frictional force. Multiple pusher plates 490 may be used herein. The slot fold mechanism 460 may have an assembly drive mechanism 510 to maneuver the slot fold mechanism 460 vertically up and down or in any type of direction. Any type of drive mechanism may be used herein.

The presentation station 190 may take the form of a multiple slot presentation tray 530. The multiple slot presentation tray 530 may have a number of slots 540 therein. A first group 550 of the slots 540 may accommodate two napkins 130, a second group 560 of the slots 540 may accommodate four napkins 130, and a third group 570 of slots 540 may accommodate six napkins 130. The groups may accommodate any number of the napkins 130. Any number of groups may be used herein. Any type of a user interface 200 may be used herein.

In use, the first roll 390 may be loaded through the first door 410 while the second roll 400 may be loaded through the second door 420 of the door loading mechanism 405. The tail 125 of each roll 390, 400 may be positioned about the respective pair of pinch rollers 440, 450 of the roller mechanism 435 and fed therein. As the respective pair of pinch rollers 440, 450 pull the sheet material 120 downward, the pusher plate 490 of the slot fold mechanism 460 drives the sheet material 120 into the slot 480 so as to create the fold 135. The force of the pusher plate 490 also may separate the perforations 235 while the leading edge of the next napkin 130 is held via the pair of pinch rollers 440, 450. The pusher plate 490 then may be withdrawn so as to leave the napkin 130 in one of the slots 540. The slot fold mechanism 460 may be maneuvered vertically via the assembly drive mechanism 510 such that a napkin 130 may be positioned within the slots 540 of each of the groups 550, 560, 570 by the pusher plate 490. The appropriate group of napkins 130 may be removed by the end user. The presentation tray 530 then may be reloaded as above. Other components and other configurations may be used herein.

Figure 7:
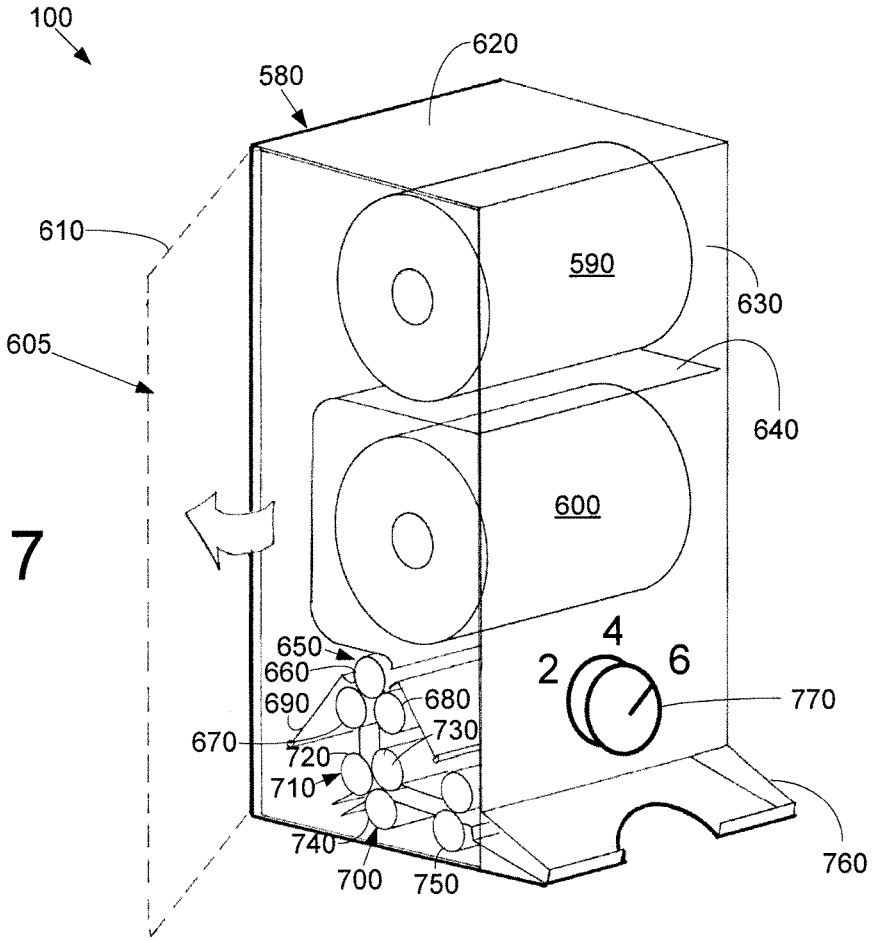
FIG. 7 is a perspective view of a fourth alternative embodiment of a napkin dispenser as may be described herein with a partially transparent outer shell.
Figure 8:
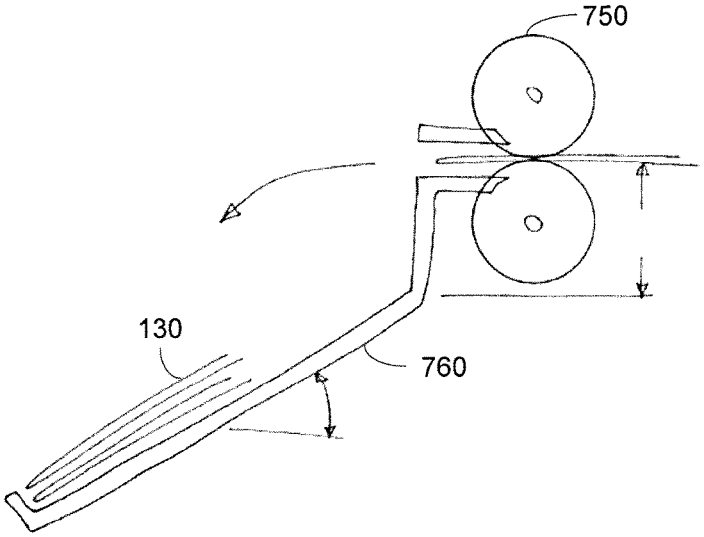
FIG. 8 is a partial side view of the napkin dispenser of FIG. 7.

FIGS. 7 and 8 show a fourth example of the napkin dispenser 100 as may be described herein as a multi-roll, reverse fold, vertical dispenser 580. The dispenser 580 may use a number of the rolls 110. In this example, a first roll 590 and a second roll 600 are used, although any suitable number of the rolls 110 may be used herein. The loading mechanism 145 of the loading station 140 may include a side door loading mechanism 405 with one or more side loading doors 610. The rolls 590, 600 may be spindle loaded through the side loading door 610. The first roll 590 may unwind along a back side 620 of the outer shell 210 while the second roll 600 may unwind along a front side 630 of the outer shell 210. A sheet guide 640 may be used between the rolls 590, 600.

The transfer mechanism 150 may take the form of a multi-roller mechanism 650. The multi-roller mechanism 650 may be positioned under the rolls 590, 600. The multi-roller mechanism 650 may include a top feed roller 660 and a pair of bottom directional rollers: a first directional roller 670 and a second directional roller 680. Some or all of the rollers 660, 670, 680 may be motor driven. The top feed roller 660 may cooperate with the first directional roller 670 to pull the sheet material 120 off of the first roller 590 while the top feed roller 660 may cooperate with the second directional roller 680 to pull the sheet material 120 off of the second roll 600. A tucker finger 690 may be positioned adjacent the side loading door 610 so as to tuck the tails 125 of each roll 590, 600 into the multi-roller mechanism 650. Other positions may be used herein.

The folding station 160 of the dispenser 580 may include the folding mechanism 170 in the form of a reverse fold mechanism 700. The reverse fold mechanism 700 may include a reverse drive mechanism 710 positioned downstream of the multi-roller mechanism 650. The reverse drive mechanism 710 may include a pair of drive rollers: a first drive roller 720 and second drive roller 730, and a directional roller 740. Some or all of the rollers 720, 730, 740 may be motor driven. The reverse fold mechanism 700 also may include a pair of rollers 750 positioned downstream of the reverse fold mechanism 700. The rollers 750 may be spring loaded and motor driven.

The presentation station 190 may include a presentation tray 760. The presentation tray 760 may be partially covered. A presentation tray 760 may be positioned on either or both ends 620, 630 of the outer shell 210. The user interface 200 may take the form of an adjustable knob 770 or other type of selector so as to indicate the number of napkins 130 to be dispensed therefrom.

In use, the rolls 590, 600 may be loaded via the side loading door 610 of the side door loading mechanism. The tail 125 of the first roll 590 may extend along the back side 620 towards the multi-roller mechanism 650 while the tail 125 of the second roll 600 may extend along the front side 630 towards the multi-roller mechanism 650. The tucker finger 690 feed the tails 125 into the multi-roller mechanism 650 when the side door 610 is closed. When the first roll 590 is to be dispensed, the top feed guide roller 660 of the multi-roller mechanism 650 may rotate in a counterclockwise direction while the first directional roller 670 rotates in a clockwise direction. When the second roll 600 is to be dispensed, the top feed guide roller 660 may rotate in a clockwise direction while the second directional roller 680 rotates in a counterclockwise direction. (These rotational directions are by way of example and only refer to relative as opposed to absolute directions. Any direction of rotation may be used herein in any order or orientation.)

In either orientation, the tail 125 is fed from the multi-roller mechanism 650 into the reverse drive mechanism 710 of the reverse fold mechanism 700. The first drive roller 720 may rotate in a clockwise direction while the second drive roller 730 rotates in a counterclockwise direction so as to pull the tail 125 downward. The directional roller 740 may rotate in a counterclockwise direction to advance the sheet material 120 to the desired length. The directional roller 740 then may reverse direction such that the fold 135 is formed and is captured by the downstream rollers 750. The speed differential between the multi-roller mechanism 650 and the reverse drive mechanism 710 acting as the speed mechanism 185 so as to separate the perforations 235. The directional roller 740 then may again reverse direction so as to continue to pull the sheet material 120 downward. The now folded napkin 130 drops into the presentation tray 760. The appropriate group of napkins 130 then may be removed by the end user. The presentation tray 760 then may be reloaded as above.

Alternate examples, however, may use a cutting mechanism 180 and the like downstream of the reverse fold mechanism 700 to separate the napkins 130 as will be described in more detail below. The dispenser 580 also may use the buckle fold mechanism 270 and the like herein instead of the reverse fold mechanism 700. Other components and other configurations may be used herein.

Figure 9:
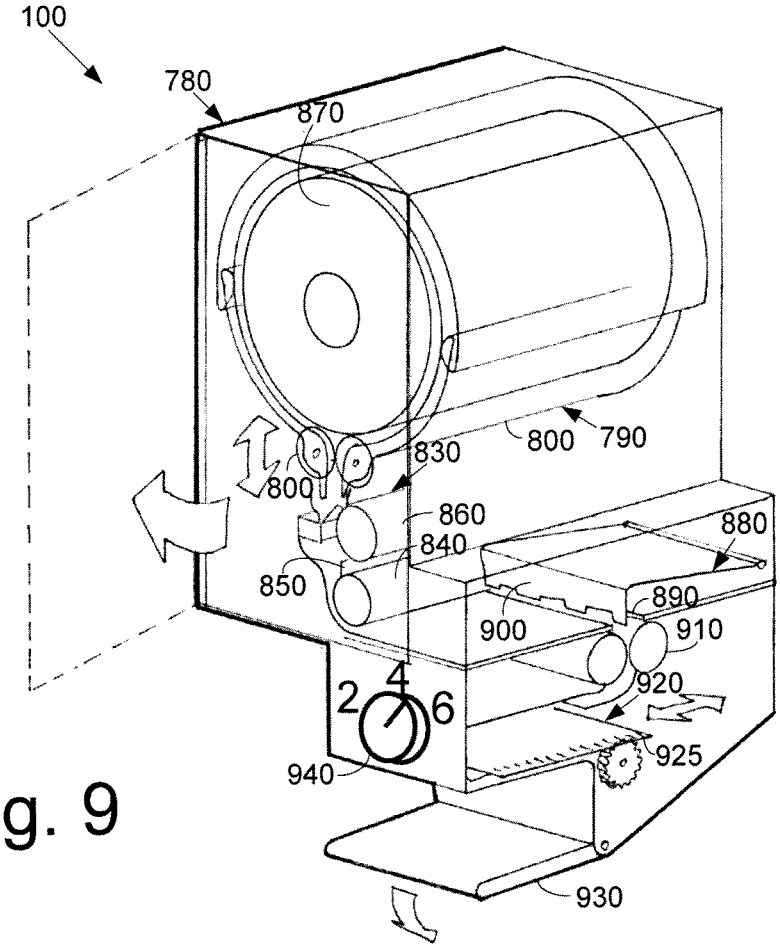
FIG. 9 is a perspective view of a fifth alternative embodiment of the napkin dispenser as may be described herein with a partially transparent shell.
Figure 10:
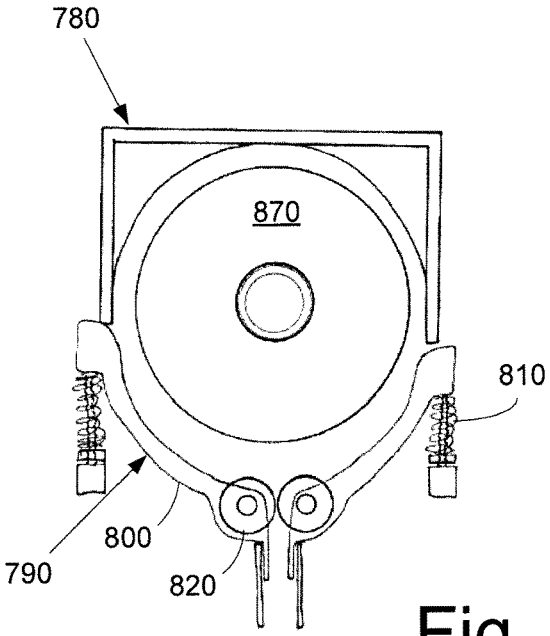
FIG. 10 is a partial side view of the napkin dispenser of FIG. 9.

FIGS. 9 and 10 show a fifth example of the napkin dispenser 100 as may be described herein as a single roll, tucker fold, vertical dispenser 780. The dispenser 780 may use the single roll 110 although additional rolls may be used. The dispenser 780 may include the loading station 140 in the form of a tail finding mechanism 790. The tail finding mechanism 790 may include a cradle 800. The cradle 800 may be spring loaded by a number of springs 810 or other types of tensioning devices. The tail finding mechanism 790 may include a pair of drive rollers 820. The pair of drive rollers 820 may be positioned about the bottom of the cradle 800. The roll 110 may be positioned with the cradle 800 via the loading door 220. The rollers 820 may rotate back and forth until the tail 125 is captured therein The loading station 140 also may include the cutting mechanism 180 as a knife assembly 830. The knife assembly 830 may include a knife roller 840 with a knife blade 850 thereon as well as an anvil roller 860. The knife assembly 830 may be used with a non-perforated roll 870 of the sheet material 120. The knife assembly 830 may cut the napkin 130 from the non-perforated roll 830 by contact between the knife roller 840 and the anvil roller 860. The knife blade 850 may be slightly angled. An additional roller may be used to maintain tension. The knife assembly 830 also may be used with a roll having the perforations 235.

The loading station 140 also may have the folding mechanism 170 in the form of a tucker fold assembly 880. As the napkin 130 advances from the knife assembly 830, the napkin 130 may be pushed through a slot 890 by a tucker bar 900 of the tucker fold assembly 880. The tucker bar 900 may be sized so as to accommodate the slot 890. The napkin 130 then may be pulled through the slot 890 via a pair of pinch rollers 910. The pinch rollers 910 may be spring loaded and motor driven. The fold 135 may be formed as the napkin 130 extends through the slot 890.

The napkin dispenser 780 also may include the presentation station 190 in the form of a hidden tray assembly 920. The hidden tray assembly 920 may include a flat tray 925 out of the normal view of the end user. The flat tray 925 may be motor driven or gear driven. A push paddle 930 may be positioned underneath the flat tray 925 and in communication with the flat tray 925. Depressing the push paddle 930 may cause the flat tray 925 to retract so as to drop a number of the napkins 130. A sensor and the like also may be used herein to initiate a dispense. The napkin dispenser 780 also may use the user interface 200 in the form of a knob 940 or other type of mechanical or electrical selector. Any suitable triggering mechanism may be used herein.

In use, the single roll 110 may be dropped into the cradle 800 of the tail finding mechanism 790. The rollers 820 may rotate back and forth until the tail 125 is captured therein. The sheet material 120 then may be pulled into the cutting mechanism 180. The knife assembly 830 cuts the sheet material 120 from the non-perforated roll 830 by contact between the knife roller 840 and the anvil roller 860. As the sheet material 120 advances from the knife assembly 830, the sheet material 120 may be pushed through a slot 890 by a tucker bar 900 in the tucker fold assembly 880 so as to create the fold 135 and the napkin 130. The napkin 130 then may drop onto the flat tray 925 of the hidden tray assembly 920. Depressing the push paddle 930 may cause the flat tray 925 to retract so as to drop one or more napkins 130 onto the push paddle 930 or on to the end user's hand. One or more trays also may be used. Other configurations and other components may be used herein.

Figure 11:
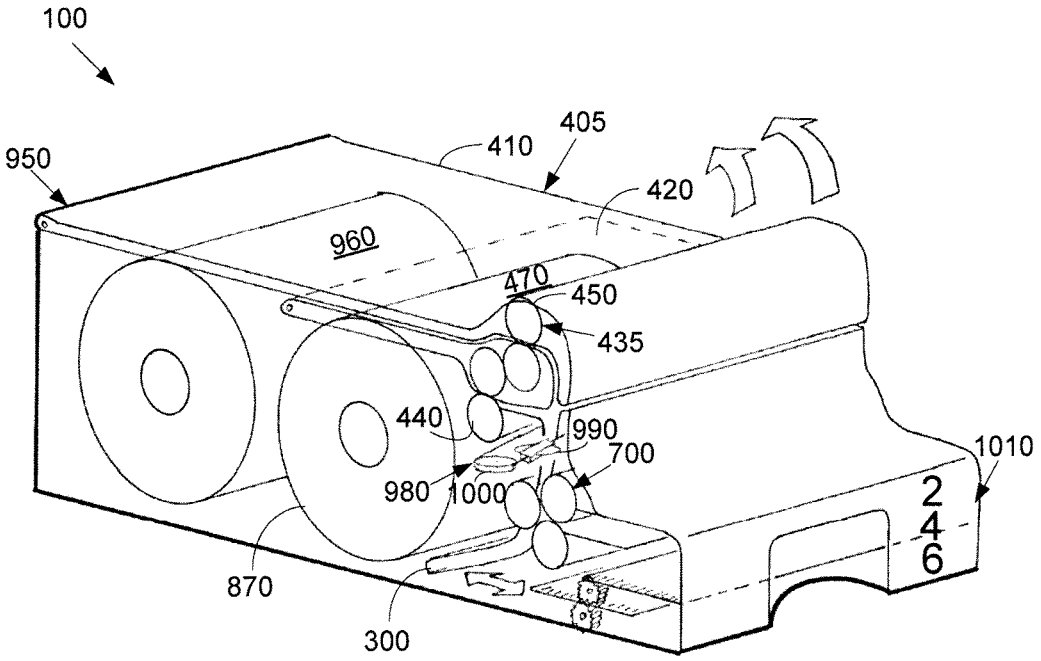
FIG. 11 is a perspective view of a sixth alternative embodiment of a napkin dispenser as may be described herein with a partially transparent outer shell.
Figure 12:
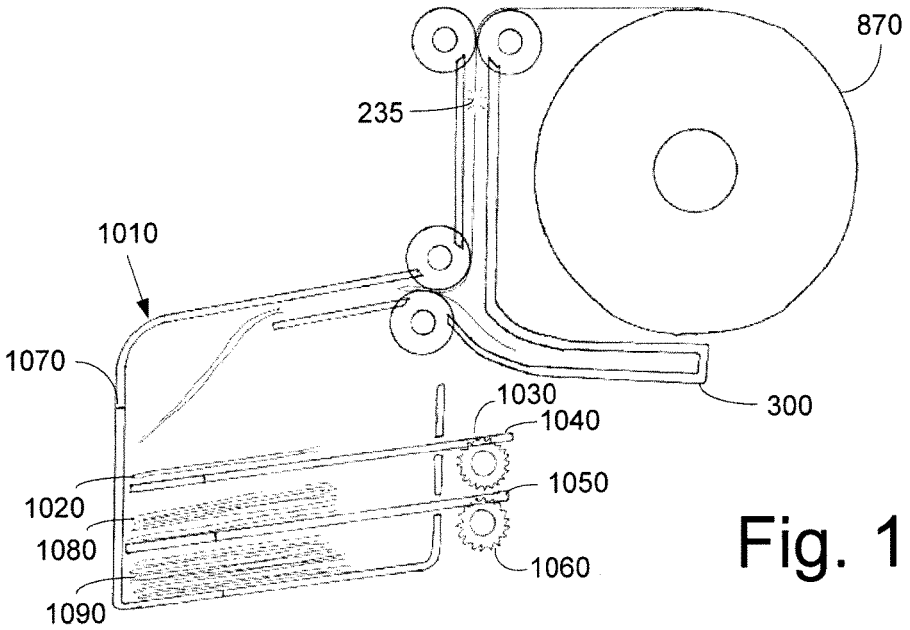
FIG. 12 is a partial side view of the napkin dispenser of FIG. 11.

FIGS. 11 and 12 show a sixth example of the napkin dispenser 100 as may be described herein as a multi roll, reverse fold, horizontal dispenser 950. The dispenser 950 may have multiple rolls 110 therein. In this example, a first roll 960 and a second roll 970 may be used although any number of the rolls may be used. The assembly 950 may use the loading station 140 in the form of the door loading mechanism 405 with the two doors 410, 420 and the pair of drive rollers 440, 450 in the roller mechanism 435 such as that shown in FIG. 5. Likewise, the dispenser 950 may use the folding station 160 with the folding mechanism 170 as the reverse fold mechanism 700 of FIG. 7 with the reverse drive mechanism 710 having the first and second drive rollers 720, 730 and the directional roller 740.

The dispenser 950 may have the cutting mechanism 180 in the form of a wheel cutter 980 if a non-perforated roll 870 is used. The wheel cutter 980 may have a cutting wheel 990 maneuvered by a pulley 1000 and the like. The pulley 1000 may pull the wheel cutter 980 over the sheet material 120 so as to separate the napkins. A speed differential created by a number of pinch rollers and the like also may be used to separate the perforations 235 as described above if a perforated roll 110 is used.

The dispenser 950 may have the presentation station 190 in the form of a presentation bucket 1010 with a number of trays 1020 therein. The trays 1020 may be divided by a number of shelves 1030. In this example, a first shelf 1040 and a second shelf 1050 are shown. Any number of the shelves may be used herein. Each of the shelves 1040, 1050 may have a shelf motor 1060 positioned thereabout. The shelf motor 1060 may retract one or both of the shelves 1040, 1050. The shelves 1030 may form a first tray 1070, a second tray 1080, and a third tray 1090. Any number of trays 1020 may be used herein. Any type of user interface 200 may be used herein.

In use, the rolls 960, 970 may be loaded within the doors 410, 420 of the door loading assembly 405 and fed through the pinch rollers 440, 450 of the roller mechanism 435. The fold 135 then may be formed via the reverse fold mechanism 700 or a similar device. Once the appropriate length of sheet material 120 has advanced, the wheel cutter 980 may cut the sheet material 120 via the cutting wheel 990 advancing along the pulley 1000. Alternatively, the speed of the respective pinch rollers may be used to separate a perforation 235 if perforated paper is used. Each napkin 130 then may fall into the presentation bucket 1010. The third tray 1090 may hold, for example, six napkins 130, the second tray 1080 may hold four napkins 130, and the first tray 1070 may hold two napkins 130. The appropriate number of napkins 130 then may be removed from the appropriate tray 1020 by the end user. In order to reload the presentation bucket 1010, the first and the second shelves 1040, 1050 may be retracted via the shelf motors 1060. Six napkins 130 then may drop into the third tray 1090. The second shelf 1050 then may close such that four napkins 130 may drop into the second tray 1080. The first shelf 1040 then may close such that two napkins 130 may drop into the first tray 1070. Other shelf opening and loading techniques may be used herein. Other components and other configurations may be used herein.

Figure 13:
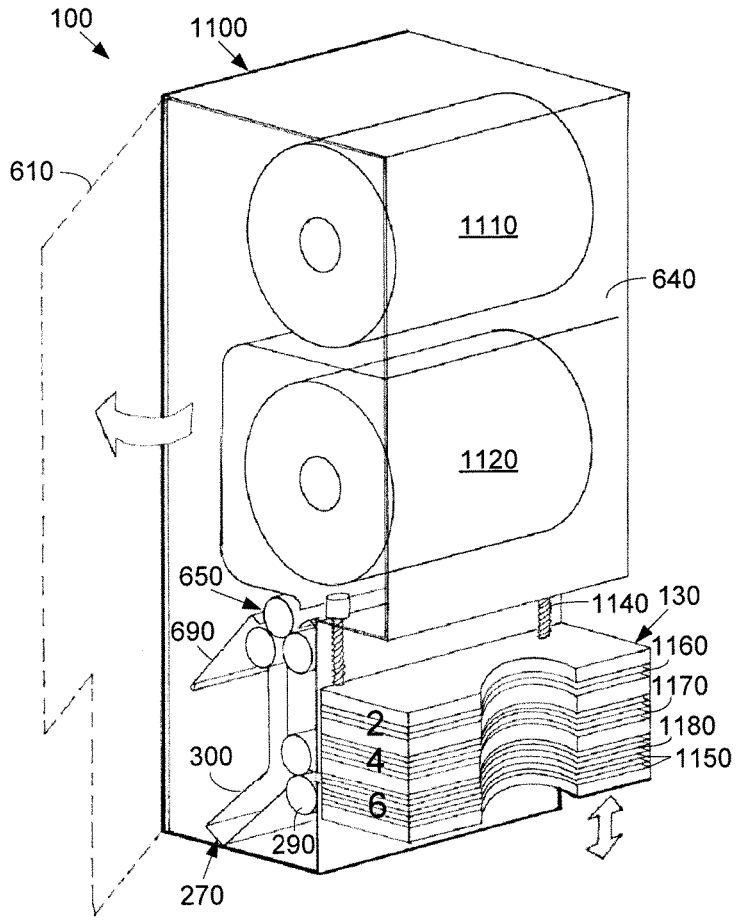
FIG. 13 is a perspective view of a seventh alternative embodiment of a napkin dispenser as may be described herein with a partially transparent outer shell.
Figure 14:
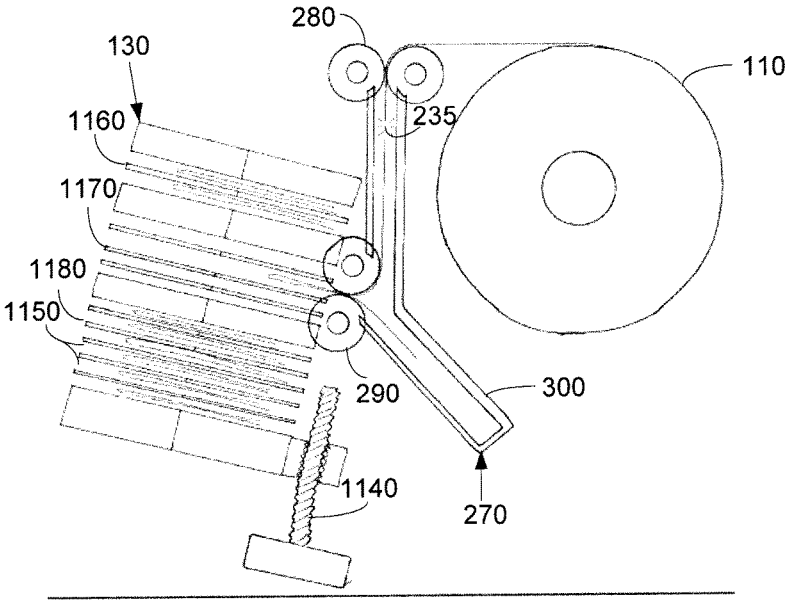
FIG. 14 is a partial side view of the napkin dispenser of FIG. 13.

FIGS. 13 and 14 show a seventh example of the napkin dispenser 100 as may be described herein as a multi-roll, buckle fold, vertical dispenser 1100. The dispenser 1100 may use a number of the rolls 110. In this example, a first roll 1110 and a second roll 1120 may be used although any number of the rolls 110 may be used herein. In this example, the assembly 1100 may have the loading station 140 in a manner similar to that shown in FIG. 7 with the side door loading mechanism 605 having the side loading door 610 and the guide 640 positioned between the rolls 1110, 1120. The loading station 140 also may use the transfer mechanism 150 in the form of the multi-roller mechanism 650. The dispenser 1100 further may use the folding station 160 with the folding mechanism 170 similar to the buckle fold mechanism 270 with the pinch rollers 280, 290 and the buckle tray 300 described above.

The dispenser 1100 may have the presentation station 190 in the form of a multi-slot maneuverable presentation tray 1130. The multi-slot maneuverable presentation tray 1130 may have a vertical drive mechanism 1140 positioned adjacent to the buckle fold mechanism 270. The multi-slot maneuverable presentation tray 1130 may have a number of slots 1150 therein. The slots 1150 may be organized into groups such that a first group 1160 may have two slots 1150, a second group 1170 may have four slots 1150, and a third group 1180 may have six slots 1150. Any number of the slots and the groups may be used herein. The vertical drive mechanism 1140 drives the multi-slot maneuverable presentation tray 1130 up and down such that the buckle fold mechanism 270 may deliver the appropriate number of napkins 130 into each group 1160, 1170, 1180. The napkins 130 may be removed as a group by the end user. The presentation tray 1130 then may be reloaded as suggested above. Other components and other configurations may be used herein.

Figure 15:
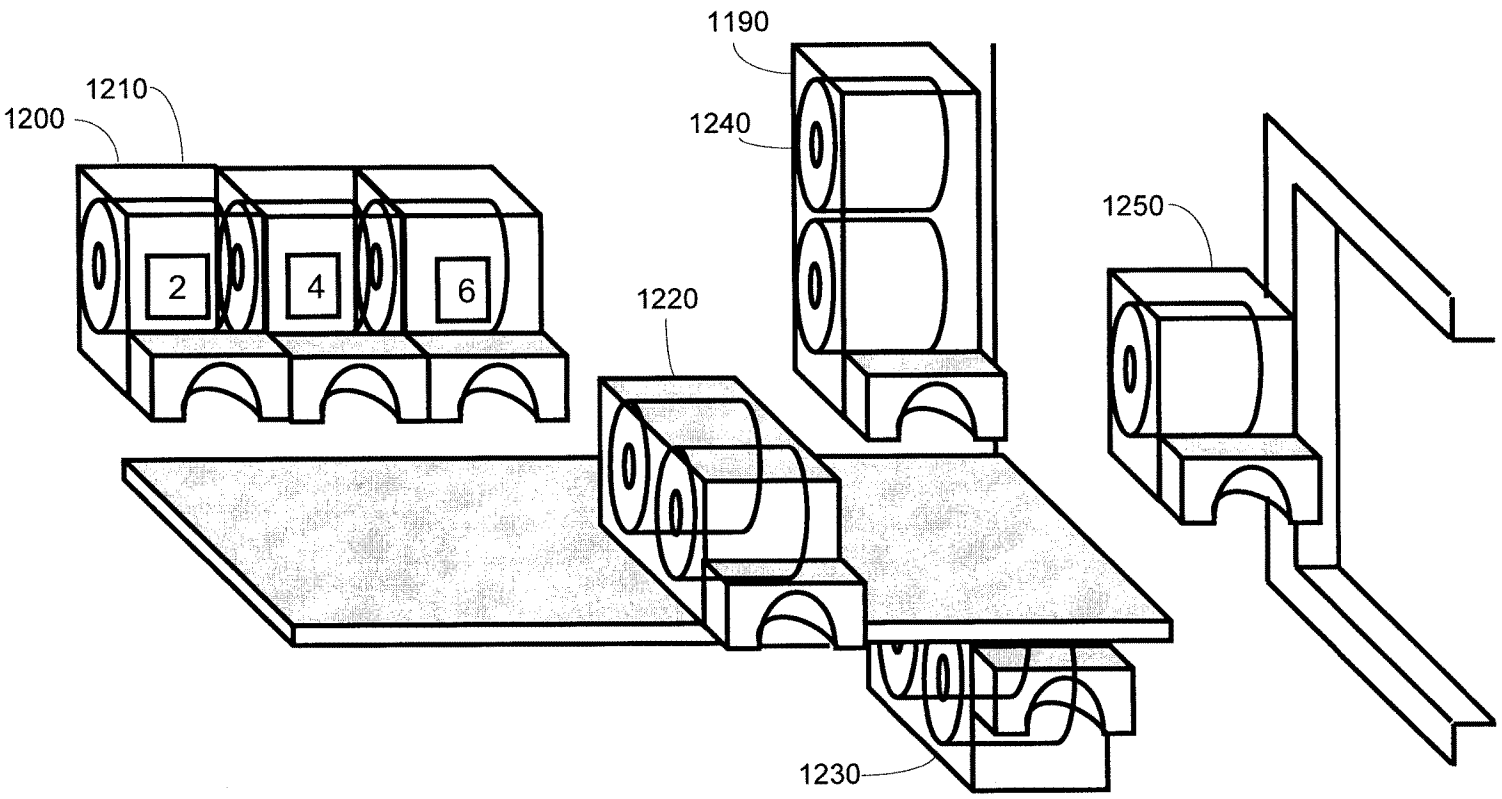
FIG. 15 is a perspective view of a number of napkin dispensers as may be described herein in several different configurations.

As can be seen, the various types of loading stations 140, the various types of folding stations 150, the various types of presentation stations 190, and the various types of user interfaces 200 may be applied in many different combinations and orientations for the overall napkin dispenser 100. Although vertical orientations 1190 and horizontal orientations 1100 are shown above, FIG. 15 also shows a side by side orientation 1210, an above-counter mount 1220, a below-counter mount 1230, a rear wall mount 1240, and a sidewall mount 1250. Other types of mounting may be used herein. In addition to the use of the various types of user interfaces 200 described herein, the dispensers also may be in direct communication with the cash register 225 or other type of ordering device. Any type of input device may be used herein. The cash register 225 or other device may indicate the number of napkins 130 to be dispensed based upon the content of the order or other parameter. Other configurations and other components may be used herein.

FIGS. 16-25 show an example of the napkin dispenser 100 as a tucker fold dispenser 1300. The tucker fold dispenser 1300 may use the single roll 110 although additional rolls also may be used herein. The single roll 110 may have the perforations 235 at substantially uniform intervals. Alternatively, non-perforated rolls also may be used herein.

Figure 16:
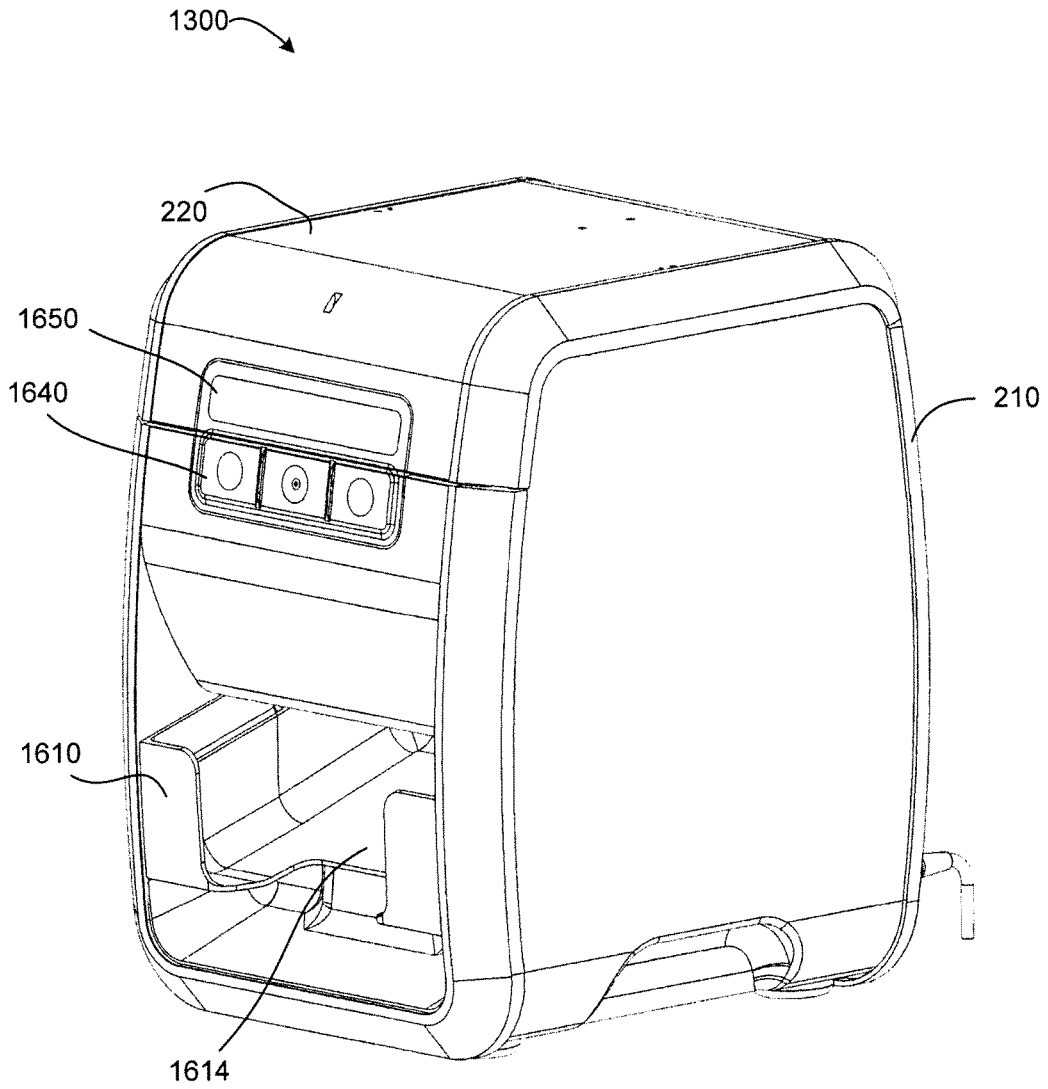
FIG. 16 is a perspective view of a further alternative embodiment of a napkin dispenser as may be described herein in the form of a tucker fold dispenser.
Figure 17:
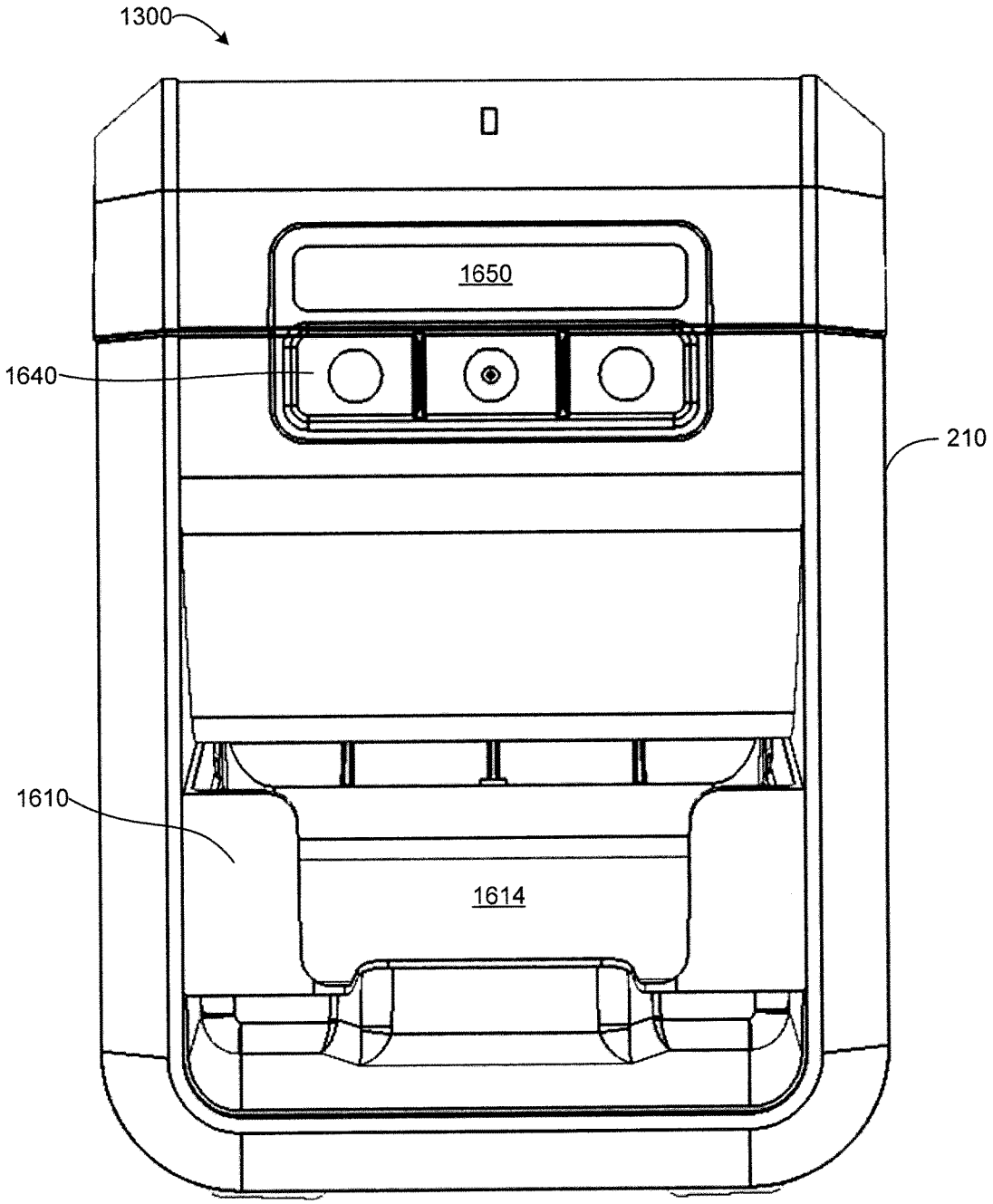
FIG. 17 is a front plan view of the tucker fold dispenser of FIG. 16.

As is shown in FIGS. 16 and 17, the tucker fold dispenser 1300 may include the outer shell 210. The outer shell 210 may be made out of any type of substantially rigid materials. The outer shell 210 may include the loading door 220. In this example, the loading door 220 may be positioned about a top of the outer shell 210 although other positions may be used herein. The tucker fold dispenser 1300 may include the loading station 140 positioned about the loading door 220. The loading station 140 may include the loading mechanism 145 in the form of a roll holder assembly 1330. The roll holder assembly 1330 may include a pair of roll holder arms 1340. The roll holder arms 1340 may cooperate with one or more spindle or core plugs 1350. The core plugs 1350 may be positioned about the single roll 110. The single roll 110 may be dropped into the roll holder assembly 1330 or otherwise positioned for rotation and dispensing therein.

Figure 18:
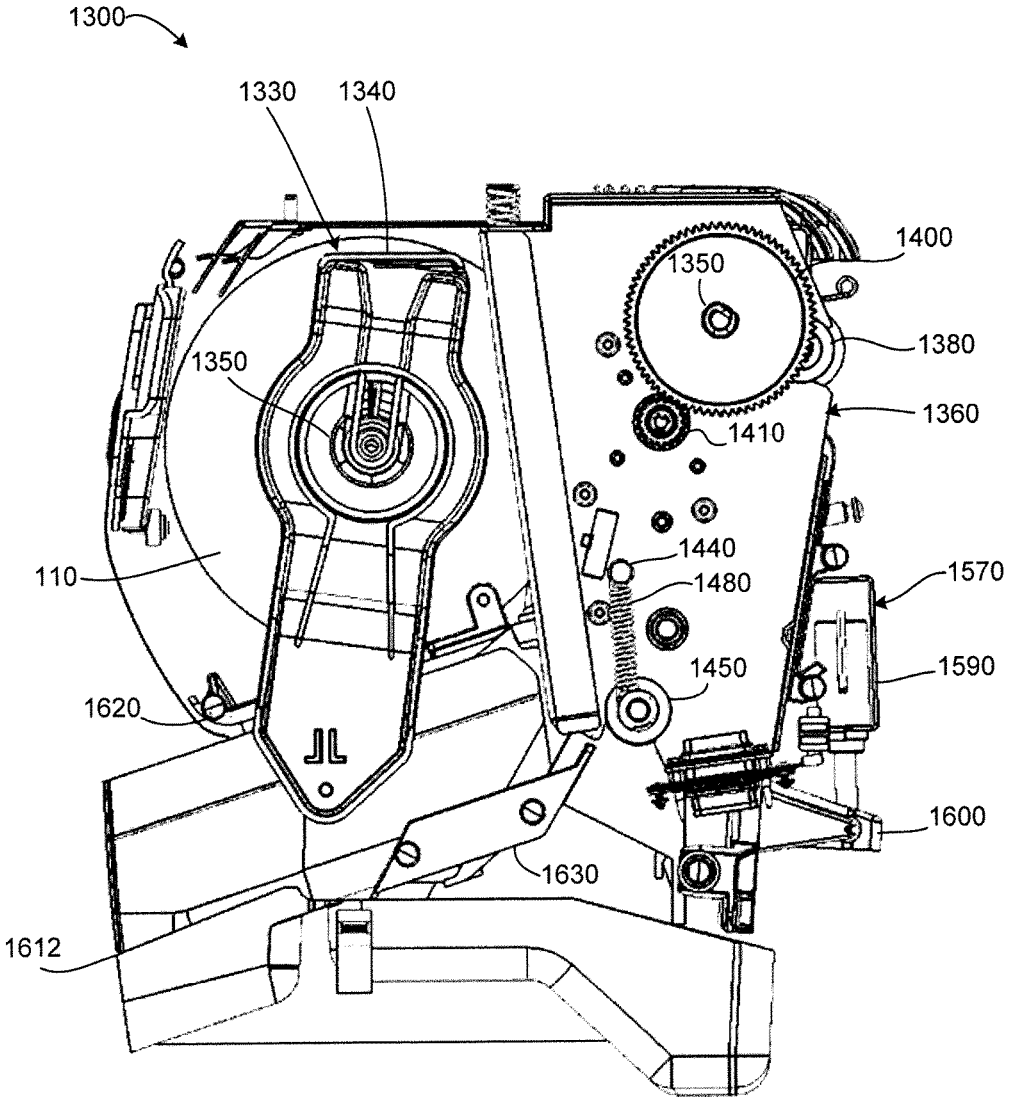
FIG. 18 is a side plan view of the internal components of the tucker fold dispenser of FIG. 16.
Figure 19:
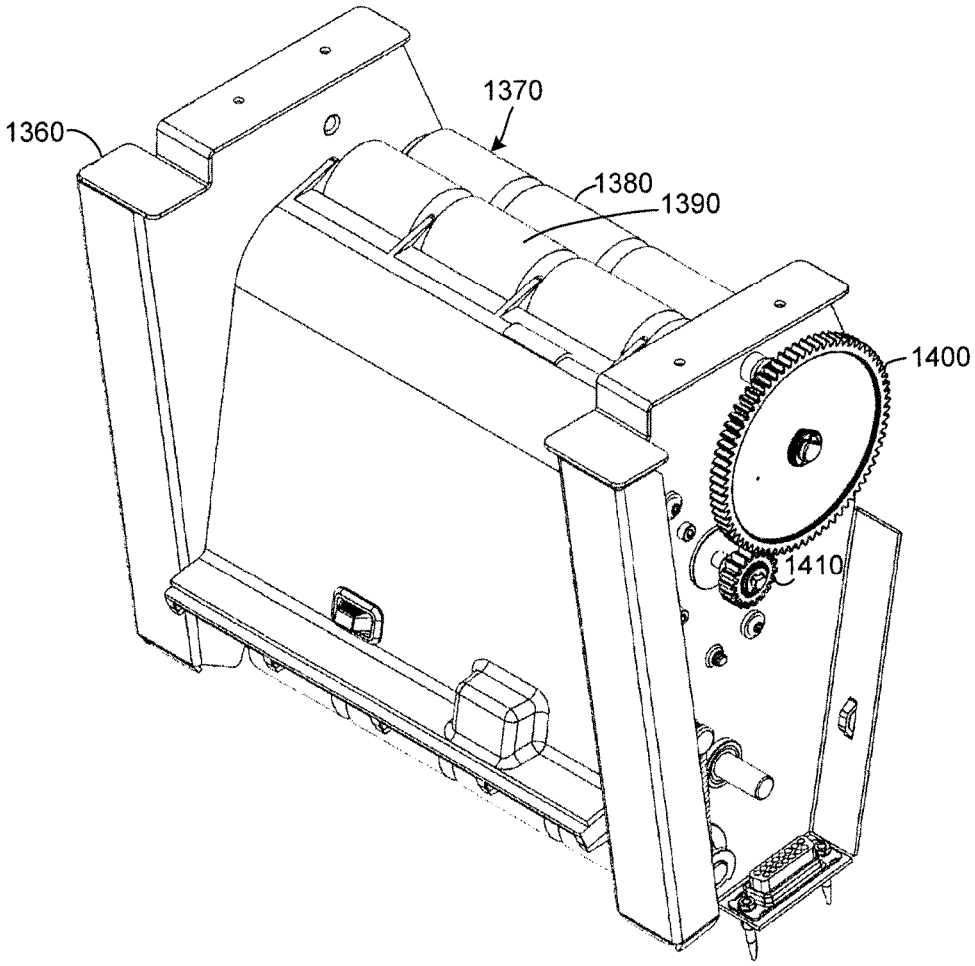
FIG. 19 is a perspective view of a roller cassette for use with the tucker fold dispenser of FIG. 16.

As is shown in FIGS. 18 and 19, the tucker fold dispenser 1300 may have the folding station 160 therein. The folding station 160 may be partially in the form of a removable roller cassette 1360. The removable roller cassette 1360 may include a pair of upper feed rollers 1370 with a first upper feed roller 1380 and a second upper feed roller 1390. Additional rollers may be used herein. The upper feed rollers 1370 may be driven by an upper feed roller gear 1400 and an upper feed roller pinion 1410. The upper feed roller pinion 1410 may be motor driven. A conventional electrical motor or other types of drive mechanisms may be used. One or more of the upper feed rollers 1370 may include a feed roller spring 1420 attached thereto. The feed roller spring 1420 may maintain the upper feed rollers 1370 engaged with the sheet material 120 under suitable tension. Other components and other configurations may be used herein.

The removable roller cassette 1360 also may include a pair of lower folding rollers 1430 with a first lower folding roller 1440 and a second lower folding roller 1450. Additional rollers may be used herein. The lower folding rollers 1430 may be driven by a lower folding gear 1460 and a lower folding roller pinion 1470. The lower folder rolling pinion 1470 may be motor driven. A conventional electrical motor or other types of drive mechanisms may be used. One or both of the lower folding rollers 1430 may include a folding roller spring 1480 attached thereto. The folding roller spring 1480 may maintain the lower folding rollers 1430 engaged with the sheet material 120 under suitable tension. Other components and other configurations may be used herein.

The removable roller cassette 1360 may define a portion of a paper path 1490 therethrough. The paper path 1490 may be defined by a fixed first wall 1500 outside of the removable roller cassette 1360 and a second wall 1510 that is part of the cassette. The first wall 1500 may be relatively straight. The second wall 1510 may have a relatively straight upper section 1530, a folding roller gap 1540 positioned about the lower folding rollers 1430, and an offset lower section 1550. The offset lower section 1550 may expand the width of the paper path 1490 so as to prevent premature feeding of the sheet material 120 into the lower folding rollers 1430. A paper path sensor 1560 may be positioned about the lower section 1550 of the second wall 1510 or elsewhere. The paper path sensor 1560 may be any type of motion sensor such as a photoelectric sensor, an infrared sensor, optical recognition, and the like that may or may not require physical contact.

Figure 20A:
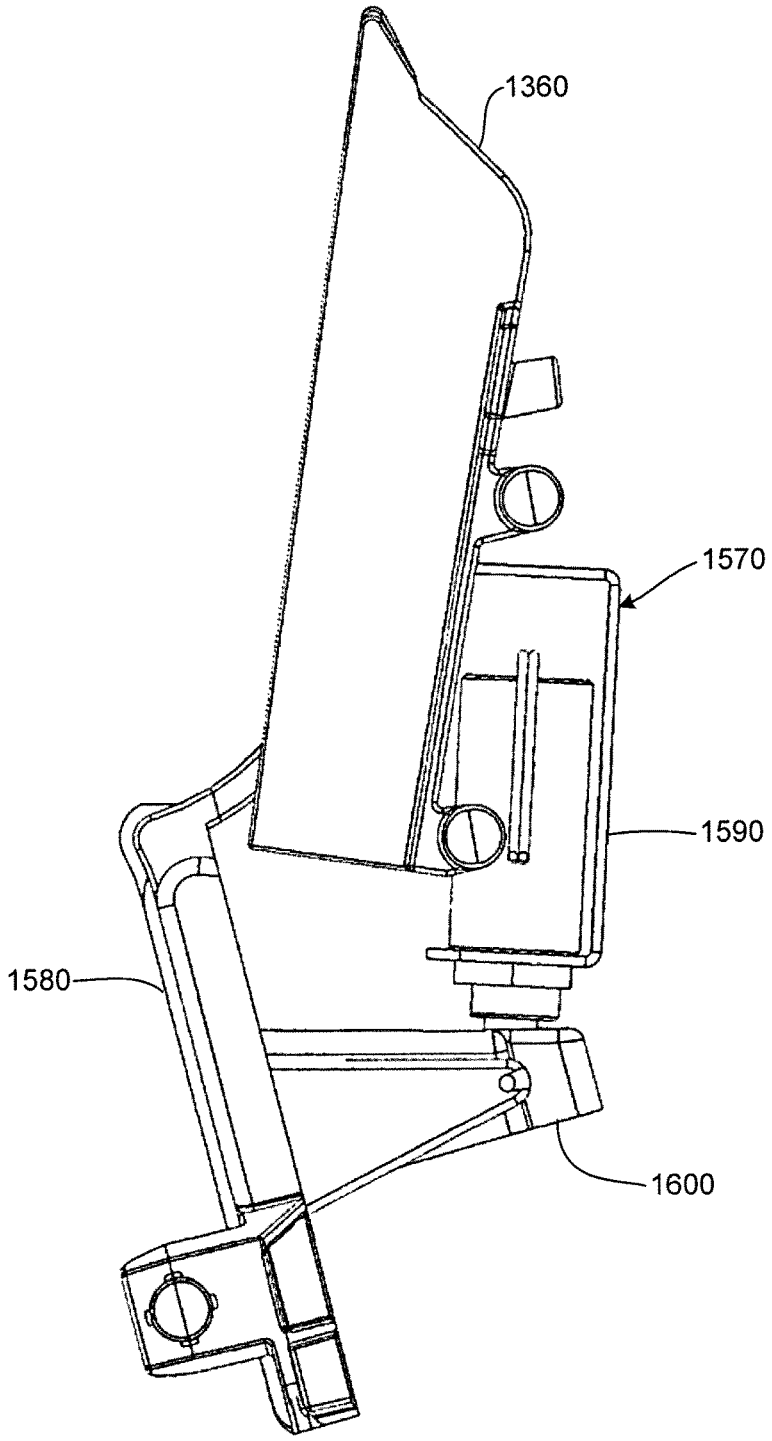
FIG. 20A is a side plan view of the roller cassette of the tucker fold dispenser of FIG. 16.
Figure 20B:
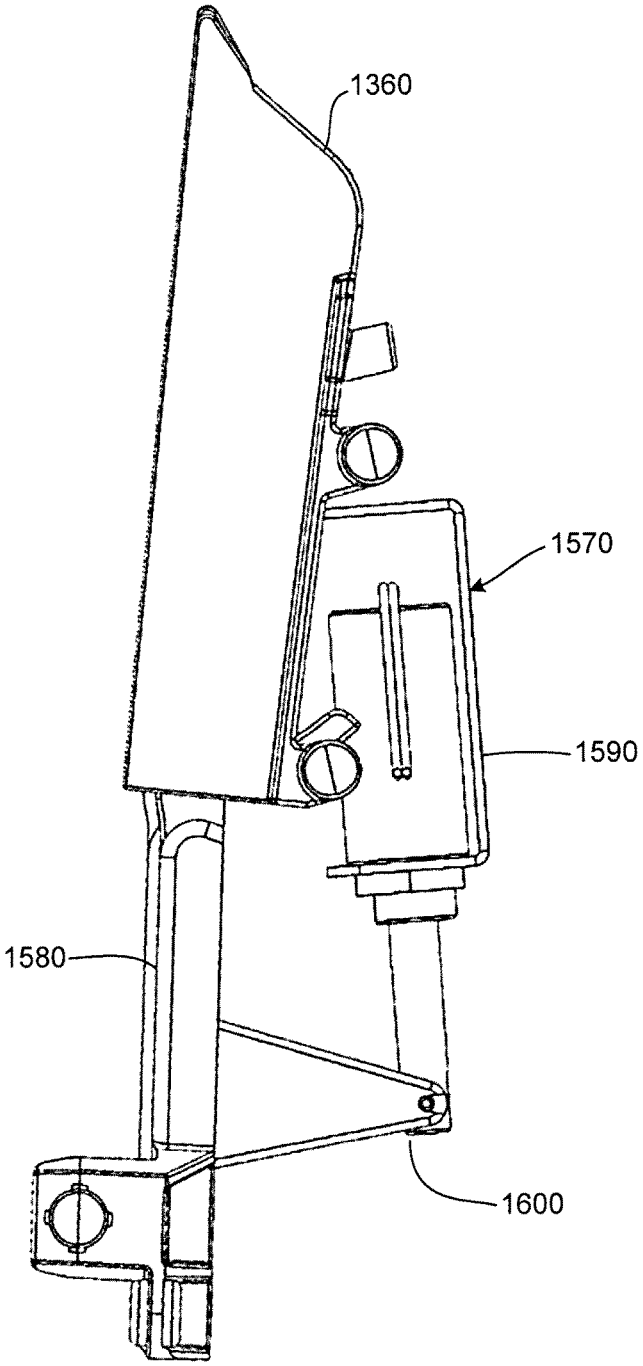
FIG. 20B is a side plan view of the roller cassette of the tucker fold dispenser of FIG. 16.
Figure 21:
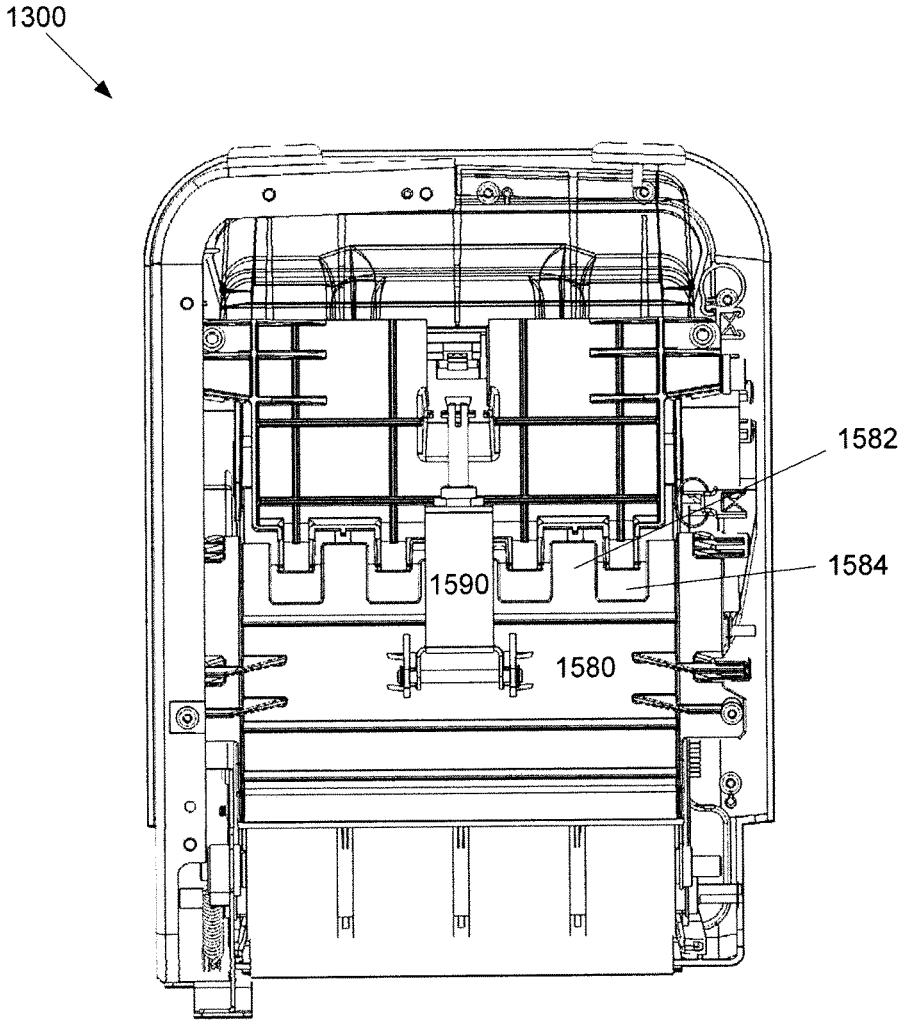
FIG. 21 is a back plan view of the roller cassette of the tucker fold dispenser of FIG. 16.

The tucker fold dispenser 1300 may include the folding mechanism 170 in the form of a tucker bar mechanism 1570. The tucker bar mechanism 1570 may be fixed adjacent to the removable roller cassette 1360 or otherwise positioned. The tucker bar mechanism 1570 may include a tucker bar 1580 positioned about the first wall 1500 adjacent to the removable roller cassette 1360. The tucker bar 1580 may be largely plate-like in shape and may extend for part or all of the width of the paper path 1490. The tucker bar 1580 may include a number of tucker bar fingers 1582 that may be positioned about a number of first wall gaps 1584 for overlapping therewith. The overlap also assists in preventing the premature feeding of the sheet material 120 into the lower folding rollers 1430. The tucker bar 1580 may be driven by a solenoid 1590 and a linkage mechanism 1600. As is shown in FIGS. 20A and 20B, the reciprocal motion of the solenoid 1590 causes the linkage mechanism 1600 to move the tucker bar 1580 in and out towards the lower folding rollers 1430. Other types of drive mechanisms may be used herein. The tucker bar 1580 and the linkage mechanism 1600 may have any suitable size, shape, or configuration. Additional tucker bar mechanisms 1570 may be used if additional folds in the sheet material 120 are desired. Other components and other configurations may be used herein.

Figure 22:
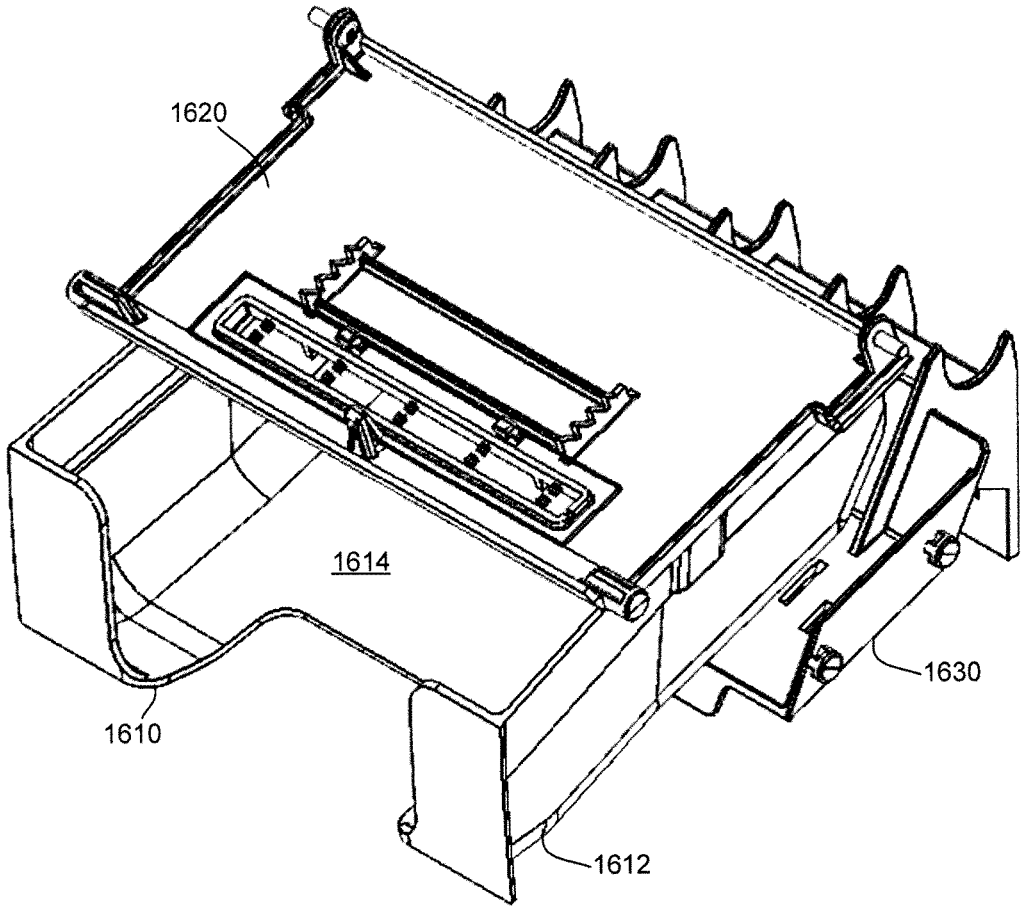
FIG. 22 is a perspective view of a presentation tray of the tucker fold dispenser of FIG. 16.
Figure 23:
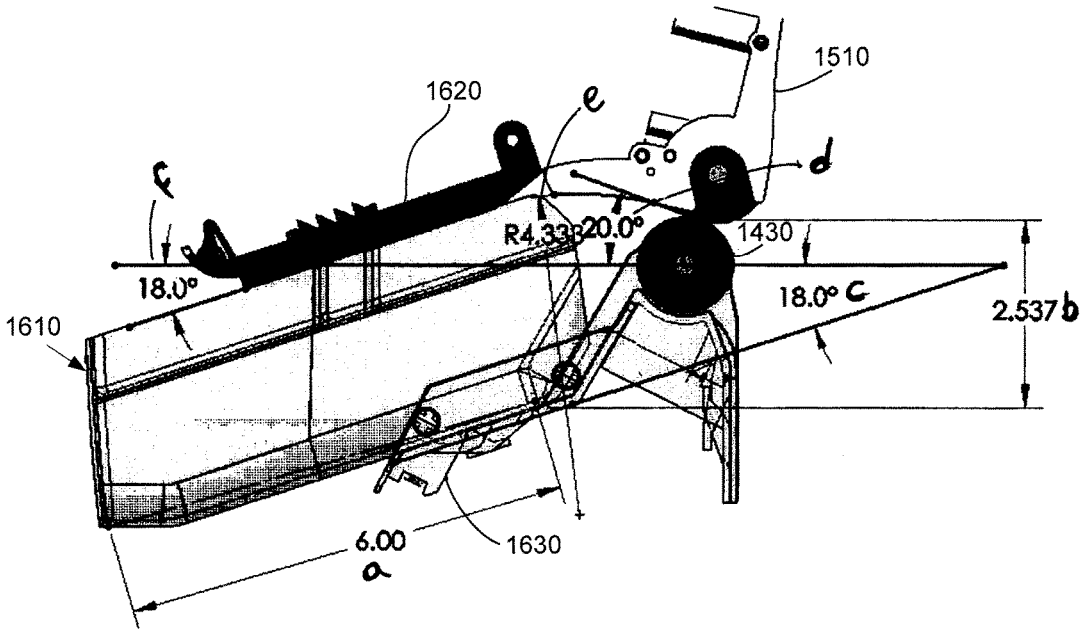
FIG. 23 is a side plan view of the presentation tray of the tucker fold dispenser of FIG. 16.
Figure 24:
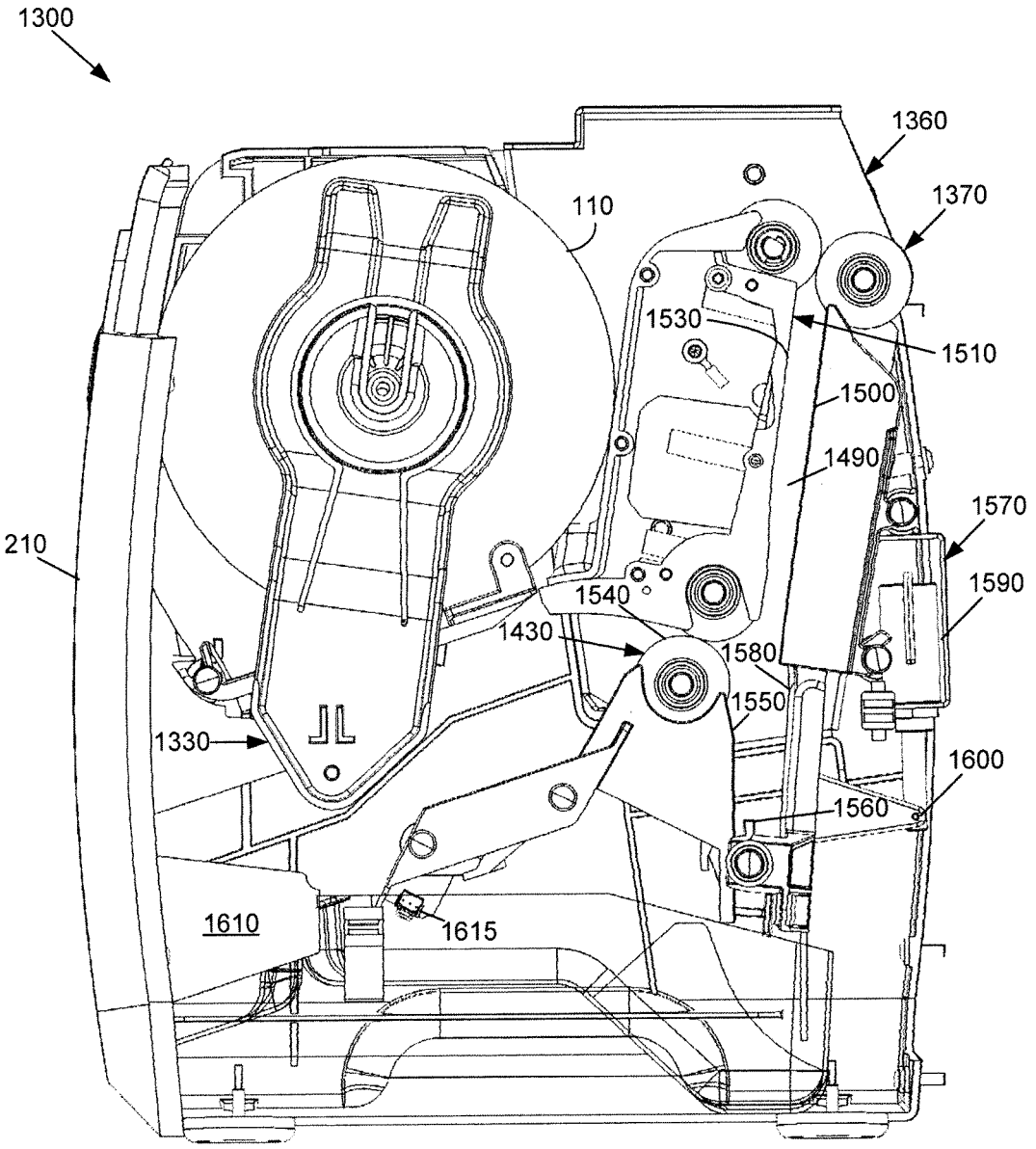
FIG. 24 is a side plan of the tucker fold dispenser of FIG. 16 in operation.
Figure 25:
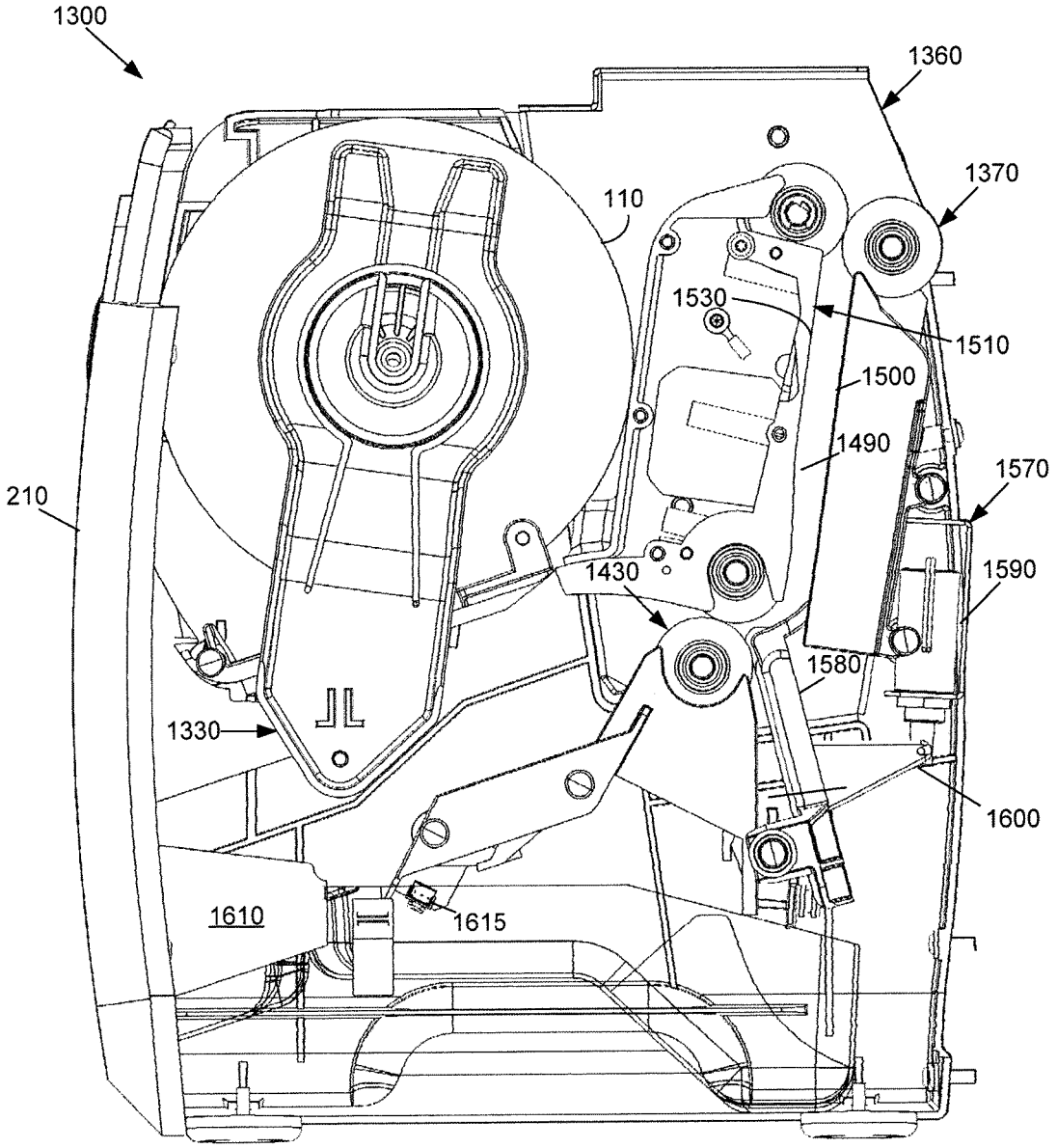
FIG. 25 is a side plan of the tucker fold dispenser of FIG. 16 in operation.

As is shown in FIGS. 22 and 23, the tucker fold dispenser 1300 may include the presentation station 190 in the form of a presentation tray 1610. The presentation tray 1610 may have a downwardly angled position 1612 and a front facing opening 1614. The downward angle may vary. The presentation tray 1610 may be in communication with the removable roller cassette 1360 via an upper paper pathway 1620 and a lower paper pathway 1630. The presentation tray 1610 and the pathways 1620, 1630 may have any suitable size, shape, or configuration. A paper tray sensor 1615 may be positioned about the presentation tray 1610 or elsewhere. The paper tray sensor 1615 may be any type of motion sensor such as a photoelectric sensor, an infrared sensor, optical recognition, and the like that may or may not require physical contact. Other components and other configurations may be used herein.

In an embodiment, the presentation tray 1610 may have a length a of about a length of a conventional napkin 130 divided in half (i.e., a once folded napkin) with any suitable length offset and tolerances. The offset preferably may be less than about ten percent or so. The presentation tray 1610 also may have a width of a conventional napkin with any suitable width offset and tolerances. The offset preferably may be less than about then percent or so. A height b of the presentation tray 1610 may be a desired number of napkins 130 plus tolerances. For example, the height b may be about ten napkins 130 or so. The height b here is also the napkin drop height for the first napkin 130. A bottom tray angle c may be measured between a horizontal line though the bottom folding roller 1430 and the lower paper pathway 1630. The bottom tray angle c may be between about zero degrees to about forty-five degrees, preferably between about ten degrees to about thirty degrees, and with about eighteen degrees shown. A roller exit angle d between the folding rollers 1430 may be between about zero degrees to about ninety degrees, preferably between about ten degrees to about thirty degrees, and with about twenty degrees shown. A top tray arch e (the area that the napkin 130 may hit first) may have a radius of between about 2 millimeters to about 5 millimeters with about 4.33 millimeters shown. A top tray angle f may be the same as the bottom tray angle c or at least in the same range. Other dimensions and other angles may be used herein.

The result of these angles and configurations thus may result in a substantially uniform stack within the presentation tray 1610. Preferably, a stack of any number of napkins 130 may be aligned in two dimensions, within ten percent of each other in any one dimension and preferably within five percent of each other in any one dimension. In other words, the stack may appear to be pre-aligned despite each individual napkin 130 being lofted into the presentation tray 1610 one after the other to create the stack therein.

The tucker fold dispenser 1300 may include the user interface 200 in the form of an input/output device 1640 and/or a display screen 1650. The input/output device 1640 and the display screen 1650 may or may not be used. The input/output device 1640 and the display screen 1650 may be of conventional design. Other types of selection means and input means may be used herein. For example, a conventional cash register and the like may be in communication herein. A conventional control device may be in communication with the input/output device 1640, the display screen 1650, as well as the sensors 1560, 1615, and the drive motors. Any type of programmable processing device may be used herein. The control device may be internal or externally positioned. Other components and other configurations may be used herein.

In use, the single roll 110 may be dropped within the roll holder assembly 1330. The roll 110 may be loaded in an underhanded fashion so as to accommodate the natural curl therein towards the first wall 1500 in order to reduce the likelihood of premature feeding of the tail 125 into the lower folding rollers 1430. The tail 125 of the sheet material 120 may be fed into the nip in between the upper feed rollers 1370. The sheet material 120 may be urged into the nip via the tucker finger 260 and the like on the loading door 220 or elsewhere. The upper feed rollers 1370 may be oriented at an angle in order to feed the sheet material 120 towards the first wall 1500 so as to reduce the likelihood of premature feeding of the sheet material 120 into the folding rollers 1430 as the material advances along the paper path 1490. The upper feed rollers 1370 may be positioned at about ten degrees (10°) to about twenty degrees (20°) or so from the horizontal. Other angles may be used herein. The offset lower section 1550 of the second wall 1510 gives the tail 125 of the sheet material 120 sufficient room so as to also assist in preventing premature feeding therein. Specifically, this larger area also lowers the chance that static will pull the sheet material 120 into the nip of the lower folding rollers 1430.

In one embodiment, once the tail 125 of the sheet material 120 reaches the paper path sensor 1560, the solenoid 1590 of the tucker bar mechanism 1570 may be activated so as to maneuver the tucker bar 1580 towards the lower folding rollers 1430. The tucker bar mechanism 1570 is shown in a retracted position in FIG. 24 and in an engaged position in FIG. 25. The linear motion of the solenoid 1590 may be translated into rotary motion via the linkage mechanism 1600. Specifically, the linkage mechanism 1600 maneuvers the tucker bar 1580 against or at least close to the second lower folding roller 1450 so as to create a frictional force between the sheet material 120 and the lower folding rollers 1430. This frictional force pulls the sheet material 120 into the nip and thus creates the fold. Once the sheet material 120 is fed into the folding roller nip, the solenoid 1590 may be deactivated and the tucker bar 1580 may return to its original position. The tucker bar 1580 may be spring loaded. The maximum force applied to the folding rollers 1430 may be a factor of the spring constant and the degree of rotation past contact (torsional spring). This design allows for intentional interference and may accommodate manufacturing variation and tolerance stack.

As the sheet material 120 is pulled into the folding rollers 1430, the next row of perforations 235 on the sheet material 120 may be just below the upper feed rollers 1370. The upper feed rollers 1370 and the lower folding rollers 1430 thus act as the speed mechanism 185. Specifically, due to a speed differential between the upper feed rollers 1370 and the lower folding rollers 1430, a force may be created in the sheet material 120 that is greater than the tensile strength of the perforations 235 so as to pop the perforations 235 without allowing the sheet material 120 to be ripped if the tail 125 is prematurely fed into the nip. Alternatively, a cutting mechanism and the like also may be used.

The lower folding rollers 1430 may be positioned at an angle so as to provide loft as the now folded napkin 130 is driven out of the lower folding rollers 1430 and into the presentation tray 1610 through the upper paper pathway 1620 and the lower paper pathway 1630 and against the top tray arch e. Other types of arches and no contact embodiments also may be used. The lower folding rollers 1430 may have enough spring force to form a crisp fold without losing traction against the sheet material 120. As described above, the lower folding rollers 1430 preferably may be positioned at about ten degrees (10°) to about thirty degrees (30°) or so from the vertical. Other angles may be used herein. The combination of the upward angle of the folding rollers 1430 and the downward angle 1612 of the presentation tray 1610 allows for a number of napkins 130 to be lofted into the presentation tray 1610 and be neatly stacked therein. The nature of the lofting assists in the neat stacking therein. The presentation tray 1610 may provide for neatly stacking about ten (10) napkins 130 or so in the tray at one time. A stack with any suitable number of napkins 130 may be used herein. The napkins 130 may be removed from the front facing opening 1614 of the presentation tray 1610 or otherwise removed.

Both the upper feed rollers 1370 and the lower folding rollers 1430 may continue to operate until the folded napkin 130 lands in the presentation tray 1610 and triggers the tray sensor 1615. Both roller drive motors then may be turned off simultaneously. Alternatively, independent operation also may be used. The nature of the fold in the napkins 130 may be adjusted by moving the position of the paper path sensor 1560 so as to change the timing of the tucker bar actuation. The cycle then may begin again.

In case of a paper jam, the removable roller cassette 1360 may be removed from the outer shell 210 and the paper path 1490 easily cleared. Alternatively, the tucker bar 1580 may be activated so as to push any remaining sheet material 120 outward through the lower folding rollers 1430.

The nature of the dispense of the folded napkin 130 into the presentation tray 1610 also may vary. The angle of the lower folding rollers 1430 may vary the "loft" with which the napkin 130 is ejected therefrom. Likewise, the angle and positioning of the upper and lower pathways 1620, 1630 as well as the presentation tray 1610 also may vary. Further, the nature of the sheet material 120 may have an impact given the type of material, the nature of the folds, as well as the direction of the fold. The specific combination of angles and orientations described herein provides for the improved presentation, appearance, and stacking of the napkins 130 herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A tucker fold dispenser for folding and dispensing a sheet of material, comprising:

an outer shell; and a removable roller cassette slidably positioned within the outer shell;

a paper path therethrough the removable roller cassette;

a plurality of feed rollers positioned about the paper path;

a plurality of folding rollers positioned about the paper path; and a tucker bar mechanism positioned about the plurality of folding rollers for tucking the sheet material into the plurality of folding rollers.

2. The tucker fold dispenser of claim 1, wherein the outer shell comprises a roll holder assembly.

3. The tucker fold dispenser of claim 1, wherein the plurality of feed rollers comprises an angled position off of a horizontal axis.

4. The tucker fold dispenser of claim 1, wherein the removable roller cassette comprises a gear and a pinion to drive the plurality of feed rollers.

5. The tucker fold dispenser of claim 1, wherein the plurality of feed rollers comprises a feed roller spring.

6. The tucker fold dispenser of claim 1, wherein the plurality of folding rollers comprises an angled position off of a vertical axis.

7. The tucker fold dispenser of claim 6, wherein the angled position comprises about ten degrees to about thirty degrees.

8. The tucker fold dispenser of claim 1, wherein the removable roller cassette comprises a gear and a pinion to drive the plurality of folding rollers.

9. The tucker fold dispenser of claim 1, wherein the plurality of folding rollers comprises a folding roller spring.

10. The tucker fold dispenser of claim 1, wherein the paper path comprises a first wall about the tucker bar mechanism and a second wall about the plurality of folding rollers.

11. The tucker fold dispenser of claim 10, wherein the removable roller cassette comprises the first wall.

12. The tucker fold dispenser of claim 11, wherein the first wall comprises an offset section to accommodate a curl in the sheet material.

13. The tucker bar dispenser of claim 1, wherein the paper path comprises a paper path sensor about the plurality of folding rollers.

14. The tucker bar dispenser of claim 1, wherein the tucker bar mechanism comprises a plate-like tucker bar.

15. The tucker bar dispenser of claim 14, wherein the tucker bar mechanism comprises a linkage mechanism in communication with the plate-like tucker bar.

16. The tucker bar dispenser of claim 15, wherein the tucker bar mechanism comprises a solenoid in communication with the linkage mechanism.

17. The tucker bar dispenser of claim 14, wherein the plate-like tucker bar comprises a plurality of tucker bar fingers that overlap in the paper path to prevent premature feeding of the sheet material into the plurality of folding rollers.

18. The tucker bar dispenser of claim 1, further comprising a presentation tray.

19. The tucker bar dispenser of claim 18, wherein the presentation tray is in communication with the removable roller cassette via an upper paper pathway and a lower paper pathway.

20. The tucker bar dispenser of claim 18, wherein the presentation tray comprises a stack of napkins aligned in two dimensions.

21. The tucker bar dispenser of claim 20, wherein each napkin in the stack is aligned within ten percent of the other napkins in any one dimension.

22. The tucker bar dispenser of claim 20, wherein each napkin in the stack is aligned within five percent of the other napkins in any one dimension.

23. The tucker bar dispenser of claim 18, wherein the presentation tray comprises a paper tray sensor.

24. A tucker fold dispenser for folding and dispensing a sheet of material, comprising:

an outer shell; and a removable roller cassette slidably positioned within the outer shell;

a paper path therethrough the removable roller cassette;

a plurality of feed rollers positioned about the paper path;

a plurality of folding rollers positioned about the paper path; and a tucker bar mechanism positioned about the plurality of folding rollers for tucking the sheet material into the plurality of folding rollers;

wherein the outer shell comprises a loading door with a tucker finger.

* * * * *